US010412511B2

(12) United States Patent
Sriskandarajah

(10) Patent No.: US 10,412,511 B2
(45) Date of Patent: Sep. 10, 2019

(54) HEARING AID

(71) Applicant: SRIS TECH LIMITED, Purley Surrey (GB)

(72) Inventor: Satheesh Sriskandarajah, Purley Surrey (GB)

(73) Assignee: SRIS Tech Limited, Purley Surrey (GB)

( * ) Notice: Subject to any disclaimer, the term of this patent is extended or adjusted under 35 U.S.C. 154(b) by 0 days.

(21) Appl. No.: 15/577,703

(22) PCT Filed: May 31, 2016

(86) PCT No.: PCT/GB2016/051591
§ 371 (c)(1),
(2) Date: Nov. 28, 2017

(87) PCT Pub. No.: WO2016/193708
PCT Pub. Date: Dec. 8, 2016

(65) Prior Publication Data

US 2018/0160242 A1 Jun. 7, 2018

(30) Foreign Application Priority Data

May 29, 2015 (GB) ..... 1509283.6

(51) Int. Cl.
*H04R 25/00* (2006.01)

(52) U.S. Cl.
CPC ..... *H04R 25/606* (2013.01); *H04R 2225/025* (2013.01); *H04R 2225/67* (2013.01); *H04R 2460/13* (2013.01)

(58) Field of Classification Search
CPC ..... H04R 25/606; H04R 2460/13
See application file for complete search history.

(56) References Cited

U.S. PATENT DOCUMENTS 3,764,748 A * 10/1973 Branch ..... H04R 25/606 381/190
4,612,915 A * 9/1986 Hough ..... H04R 25/606 600/25

(Continued)

FOREIGN PATENT DOCUMENTS

EP 2134107 A2 12/2009
EP 2606849 A1 6/2013

(Continued)

OTHER PUBLICATIONS

International Patent Application PCT/GB2016/051591, International Search Report and Written Opinion dated Dec. 8, 2016, 12 pages.

(Continued)

*Primary Examiner* — Curtis A Kuntz
*Assistant Examiner* — Ryan Robinson
(74) *Attorney, Agent, or Firm* — Kilpatrick Townsend & Stockton LLP

(57) ABSTRACT

Apparatus for assisting hearing, the apparatus comprising: an in-ear component for insertion into the ear canal and comprising an electromagnet; and a bone implant for mounting in the temporal bone bordering the ear canal, the bone implant comprising a housing and a magnetic mass suspended within the housing such that vibrations of the magnetic mass are mechanically coupled into the housing; wherein the in-ear component is configured to drive its electromagnet so as to, when the in-ear component is located in an ear canal with the electromagnet adjacent to the bone implant, cause the magnetic mass to vibrate within the housing.

18 Claims, 11 Drawing Sheets

(56) References Cited

U.S. PATENT DOCUMENTS

| | | | | |
|---|---|---|---|---|
| 4,957,478 | A * | 9/1990 | Maniglia | H04R 25/554 600/25 |
| 5,015,224 | A * | 5/1991 | Maniglia | H04R 25/606 600/25 |
| 5,913,815 | A | 6/1999 | Ball et al. | |
| 6,277,148 | B1 * | 8/2001 | Dormer | A61F 2/18 600/25 |
| 6,540,662 | B2 * | 4/2003 | Kroll | H04R 25/456 600/25 |
| 6,643,378 | B2 * | 11/2003 | Schumaier | H04R 25/606 381/318 |
| 6,914,994 | B1 | 7/2005 | Shennib et al. | |
| 6,940,988 | B1 | 9/2005 | Shennib et al. | |
| 7,110,562 | B1 | 9/2006 | Feeley et al. | |
| 8,246,532 | B2 | 8/2012 | Ball et al. | |
| 8,774,930 | B2 * | 7/2014 | Ball | H04R 25/606 607/57 |
| 8,891,795 | B2 * | 11/2014 | Andersson | H04R 25/606 381/151 |
| 8,965,021 | B2 * | 2/2015 | Adamson | H04R 25/606 381/151 |
| 2007/0053536 | A1 * | 3/2007 | Westerkull | H04R 25/606 381/326 |
| 2007/0156011 | A1 | 7/2007 | Westerkull | |
| 2012/0219166 | A1 | 8/2012 | Ball | |
| 2014/0128661 | A1 | 5/2014 | Ball | |

FOREIGN PATENT DOCUMENTS

| | | | |
|---|---|---|---|
| WO | 2001/60116 | A2 | 8/2001 |
| WO | 2005/094123 | A1 | 10/2005 |
| WO | 2011/047495 | A1 | 4/2011 |

OTHER PUBLICATIONS

Hakansson, B. et al., "A novel bone conduction implant (BCI): Engineering aspects and pre-clinical studies," International Journal of Audiology, 2010, (49), 3, 203-215.

* cited by examiner

HEARING AID

BACKGROUND OF THE INVENTION

This invention relates to apparatus for assisting hearing in humans and animals, a bone implant and a hearing aid device.

A significant proportion of the population suffer some form of hearing impairment. This can be due to a variety of factors, including as a result of disease, genetic conditions, congenital malformations, removal of an acoustic neuroma and trauma. Hearing impairment can be due to problems in one or more of the outer, middle and inner ears which together form the human auditory system. Hearing impairment may be bilateral (on both sides of the head) or unilateral (occurring on only one side of the head).

Various devices have been developed to address hearing impairment. For patients with mild hearing loss, commonplace air conduction hearing aids are often sufficient. Air conduction hearing aids provide amplified sound into the ear canal so as to compensate for reduced hearing sensitivity. Sound pressure delivered through the middle ear acts on the basilar membrane producing a traveling wave that excites the sensory cells in the Organ of Corti causing an auditory sensation. However, for certain ear canal and middle ear disorders (e.g. congenital malformations, ossicular discontinuity, otosclerosis, a perforated tympanic membrane, or chronic ear infections) air conduction hearing aids cannot be used or are insufficient. In such cases, bone conduction hearing aid can be provided as an alternative.

In bone conduction (BC) hearing aids, airborne sound picked up by the hearing aid is converted into vibrations that are transmitted through the skin to the skull bone and then directly to the cochlea. This bypasses the outer and middle ears. For patients with a functioning cochlea, such devices can substantially restore normal hearing. Bone conduction hearing aids can also be useful for patients with complete unilateral hearing loss because the skull can efficiently transmit vibrations from the deaf side to the functioning cochlea on the other side of the head (known as transcranial transmission). The use of bone conduction hearing aids for patients with unilateral hearing loss can significantly reduce the head shadow effect where sounds occurring on a patient's deaf side are attenuated by their own head before reaching their good ear.

In conventional BC hearing aids, the vibrator unit is pressed against the skull through the use of a headband or by mounting the vibrator unit to spectacle frames. Such devices can be uncomfortable due to the static force required to adequately couple the vibrator unit to the skull and suffer from reduced high frequency sensitivity due to the attenuation effect of soft tissue overlying the skull, as well as feedback problems due to sound radiation from the vibrator unit being picked up by the microphone of the hearing aid. These problems led to the development of a new form of bone conduction hearing aid: percutaneous bone anchored hearing aids (BAHAs).

Bone anchored hearing aids are clipped onto a bone anchor which is mounted in the skull and penetrates out through the skin. This approach provides good coupling between the vibrator unit of the hearing aid and the skull but the skin penetration site needs lifelong daily care. Some patients may acquire a skin reaction with persistent infection and may form granulation tissue that requires surgical revision or re-implantation. The bone anchor may also suffer from problems and can be damaged through injury. Some patients will refuse a BAHA because they cannot tolerate a skin penetration implant for personal reasons or social stigma.

In response to the problems with bone anchored hearing aids, subcutaneous bone conduction implant (BCI) devices are now becoming commonplace. These devices comprise an implanted unit which is fixed into a cavity drilled out of the temporal bone of the skull. The skin is replaced over the implanted unit so there is no part of the device penetrating the skin. The implanted unit contains a vibrator which is inductively driven by an external unit held in place over the implanted unit by a strong magnet. The inductive link consists of a transmitter coil at the external unit and a receiver coil at the implanted unit: by appropriately driving the transmitter coil, a current can be induced in the receiver coil sufficient to power the vibrator. Typically, the inductive transmission carries an amplitude modulated signal which can be demodulated at the implanted unit so as to cause the vibrator to reproduce the sounds picked up at the external unit.

BCI devices bring their own set of problems. The area of skin overlying the implanted unit must be kept free of hair which for most patients means regular shaving and an unsightly bald patch. The external unit is prone to falling off when the wearer performs physical activity and can be easily knocked off. Even so, the strength of the magnet used to hold the external unit in place leads to compression of the skin, leading to irritation and potentially pressure sores.

The operation required to install the implanted unit behind the ear in the temporal bone carries a high risk of facial nerve or vestibular damage. A large volume of bone (typically around 16×16×8 mm) must be removed to create a cavity in which the implanted unit is fixed which is irreversible and can weaken the temporal bone which lies only a few millimeters over the brain. When the implanted unit needs replacing, a further surgery is required. The implanted unit must also be removed should the patient require an MRI scan, which necessitates another risky operation. Even if the patient is not harmed by the action of the strong magnetic field present in an MRI scanner on the implanted unit, the implanted unit is likely to be damaged (e.g. due to demagnetisation of the biasing magnets of the vibrator). The MRI images in the region of the implanted unit would in any case be heavily distorted due to the presence of biasing magnets in the vibrator.

A variation on the BCI device is also used which replaces the vibrator at the temporal bone with a tiny vibrating unit that is fixed to one or the bones of the middle ear (the ossicles). The implanted unit is connected to the vibrating unit by thin wires which run through a channel drilled through the temporal bone. The implanted unit is inductively powered by an external unit in the manner described above. Sound received at the external unit is thus recreated by the vibrating unit as vibrations in the ossicles of the middle ear. Such an arrangement is not suitable for use in patients with unilateral hearing loss due to problems in the middle or inner ear because the device does not generate vibrations in the temporal bone which can be conducted across the skull to the functional cochlea. The vibrations generated in the middle ear by the vibrating unit are small in magnitude and confined to the ossicles.

The surgical risks associated with the implantation of a BCI device provided with a vibrating unit for attachment into the middle ear is even greater than the risks associated with installing conventional BCI devices. In addition to creating a cavity in the temporal bone, a channel must be drilled through the temporal bone in order to (a) access the middle ear and (b) provide a route for the wires between the implanted unit and vibrating unit. Operating on the middle ear increases the risk of infection and is a difficult operation to perform due to the very small size of the ossicles. Furthermore, even with the implanted unit removed and the vibrating units adapted to present a low magnetic moment, it is risky for a patient to undergo an MRI scan because of the fragility of the ossicles and the soft structures of the middle and inner ear.

U.S. Pat. No. 6,643,378 describes an alternative type of bone conduction hearing aid which is located in the ear canal rather than behind the ear. The hearing aid comprises a piezoelectric vibrator instead of the conventional speaker unit. Vibrations generated by the vibrator are transmitted into the mastoid bone through the casing of the hearing aid so as to conduct sound into the cochlea. This design suffers from several problems, most notably poor performance due to the low coupling of vibrations into the mastoid bone due to absorption by the casing of the hearing aid and the soft tissues lining the ear canal. In order to achieve an acceptable level of performance, the hearing aid must form a tight fit in the ear canal. This leads to irritation of the lining of the ear canal and potentially pressure sores. Since the hearing aid blocks the ear canal, use of the device creates conditions in the ear which can lead to infection. Finally, and significantly to wearers of the device, the vibration of the device in the ear causes a tickling sensation in the ear of the wearer which for some patients means using the device for extended periods of time is not an option.

BRIEF SUMMARY OF THE INVENTION

According to a first aspect of the present invention there is provided apparatus for assisting hearing, the apparatus comprising:

an in-ear component for insertion into the ear canal and comprising an electromagnet; and a bone implant for mounting in bone bordering the ear canal, the bone implant comprising a housing and a magnetic mass suspended within the housing such that vibrations of the magnetic mass along a first axis are mechanically coupled into the housing;

wherein the in-ear component is configured to drive its electromagnet so as to, when the in-ear component is located in an ear canal with the electromagnet adjacent to the bone implant, cause the magnetic mass to vibrate along the first axis within the housing.

The magnetic mass may be a permanent magnet and the first axis is aligned with the polar axis of the permanent magnet.

The bone implant may be adapted for implantation such that the first axis is substantially orthogonal to the axis of the ear canal adjacent to the temporal bone, and the in-ear component is shaped such that, when the in-ear component is located in an ear canal with the electromagnet adjacent to the bone implant, the magnetic axis of the electromagnet in use is aligned with the first axis.

The bone implant may be adapted for mounting into a cavity in the temporal bone such that, in use, no part of the bone implant projects through the skin lining the ear canal.

The bone implant may further comprise one or more elastic members arranged to elastically couple the magnetic mass to the housing.

The elastic members may comprise one or more of an elastomer, an elastic membrane, a polymer spring and a metal spring.

The elastic members may comprise a plurality of elastomers arranged so as to elastically restrain movement of the magnetic mass along the first axis.

The elastic members may be adapted so as to inhibit movement in directions orthogonal to the first axis and substantially prevent the magnetic mass from contacting the housing.

The elastic members may comprise a pair of elastomers each lying on the first axis between the magnetic mass and an internal wall of the housing, the elastomers each being provided with an indentation for receiving a respective end of the magnetic mass so as to centre movement of the magnetic mass along the first axis and substantially prevent the magnetic mass from contacting the housing.

The magnetic mass and elastic members may be cooperatively adapted so as to inhibit rotation of the magnetic mass about the first axis.

The housing may comprise two parts: an outer housing adapted for implantation in the temporal bone; and an inner housing in which the magnetic mass is suspended; the inner and outer housings being adapted such that the inner housing may be removably fixed into the outer housing.

The inner and outer housings may be provided with cooperating threads such that the inner housing may be screwed into a recess provided in the outer housing.

The outer housing may be provided with a thread on its outer surface for engagement with a suitably proportioned cavity drilled into the temporal bone, the surface being coated with titanium oxide so as to, when in-situ, promote osseointegration between the bone and outer housing.

The outer housing may substantially comprise titanium or a titanium alloy.

The inner housing may comprise a chamber in which the magnetic mass is suspended, the surfaces of the chamber which in use may come into contact with the magnetic mass and/or the respective surfaces of the magnetic mass being coated so as to minimise friction and wear to the magnetic mass.

The inner housing may comprise a chamber in which the magnetic mass is suspended, the chamber being filled with one or more of: an inert gas; a lubricating oil; a fluid for, in use, improving mechanical coupling of movement of the magnetic mass into vibrations in the temporal bone.

With the exception of the magnetic mass itself, the inner housing may be non-magnetic.

The inner housing may substantially comprise ultra-high molecular weight polyethylene.

The in-ear component may further comprise a microphone arranged such that, in use, it is located proximal to the opening of the ear canal, and a processor configured to process a signal from the microphone into an oscillating current for driving the electromagnet.

The in-ear component may further comprise one or more structural members to which the electromagnet is rigidly connected, the one or more structural members being arranged to, in use, couple reaction forces on the electromagnet substantially along the length of the in-ear component.

The in-ear component may comprise a port extending substantially along the length of the in-ear component so as to, in use, connect that part of the ear canal lying between the in-ear component and the tympanic membrane to the external environment of the patient.

The bone implant may be adapted for mounting into a cavity in the temporal bone such that, in use, at least part of the magnetic mass projects out of the housing through the skin lining the ear canal.

The magnetic mass may be substantially suspended within a chamber of the housing and that part of the magnetic mass projecting out of the housing comprises an end plate greater in diameter than the diameter of the chamber.

The magnetic mass may be elastically coupled to the housing by a membrane which further acts to seal off the chamber from the ear canal.

Surfaces of the housing and/or magnetic mass which project into the ear canal may be treated by one or more of: coating with a layer of hydroxyapatite; coating with a thin carbon or metal film; and polishing said surfaces.

The apparatus may further comprise instructions to implant the bone implant into the temporal bone such that its first axis is substantially orthogonal to the axis of the ear canal adjacent to the temporal bone.

The apparatus may further comprise instructions to encase the in-ear component in a casing material according to a mould of the patient's ear canal so as to, in use, substantially constrain the orientation of the electromagnet such that its magnetic axis is aligned with the first axis of the bone implant.

The casing material may be silicone or acrylic.

The apparatus may further comprise instructions to, following its mounting in the temporal bone, cover a surface of the bone implant facing into the ear canal with a thin disc of cartilage harvested from the patient.

According to a second aspect of the present invention there is provided a bone implant comprising:

a housing for mounting in the temporal bone bordering the ear canal, the housing having a threaded recess; and a threaded insert adapted to mate with the threaded recess so as to allow the insert to be removably engaged within the housing, the insert having a magnetic mass suspended therein such that, in use when the insert is engaged within the housing, vibrations of the magnetic mass along a first axis are mechanically coupled into the housing.

The first axis may be substantially parallel to the axes of the threads of the housing and insert.

The housing may be provided with an external thread for engagement with the walls of a suitably proportioned cavity drilled into bone.

The housing may be for mounting by bone cement into a cavity drilled into bone.

The threaded insert may be a sealed unit adapted to, in use when the insert is engaged within the housing, sit flush with the end of the housing such that the insert is spaced away from the bone by the housing and no part of the bone implant projects through the skin lining the ear canal.

The bone implant may further comprise one or more elastic members arranged to elastically couple the magnetic mass to the housing.

The elastic members may comprise a plurality of elastomers arranged so as to elastically restrain movement of the magnetic mass along the first axis.

The elastic members may be adapted so as to inhibit movement in directions orthogonal to the first axis and substantially prevent the magnetic mass from contacting the housing.

The magnetic mass and elastic members may be cooperatively adapted so as to inhibit rotation of the magnetic mass about the first axis.

The bone implant may be provided with instructions to, following its mounting in the temporal bone, cover a surface of the bone implant facing into the ear canal with a thin disc of cartilage harvested from the patient.

According to a third aspect of the present invention there is provided a device for wear in the ear canal, the device comprising:

a microphone located at the distal end of the device such that, in use, the microphone is adjacent to the opening of the ear canal;

an electromagnet located at the proximal end of the device such that, in use, the electromagnet is adjacent to the temporal bone; and an amplifier configured to drive the electromagnet in dependence on the output of the microphone;

wherein the electromagnet is oriented in the device such that, in use, the poles of the varying magnetic field generated by the electromagnet are substantially transverse to the axis of the ear canal adjacent to the temporal bone.

The device may further comprise one or more structural members to which the electromagnet is rigidly connected, the one or more structural members being arranged to, in use, couple reaction forces on the electromagnet substantially along the length of the in-ear component.

The device may further comprise a port extending substantially along the length of the device so as to, in use, connect that part of the ear canal lying between the in-ear component and the tympanic membrane to the external environment of the patient.

The device may be provided with instructions to control the orientation of the magnetic axis of the electromagnet by at least partially overmoulding the device with a casing material according to a mould of the patient's ear canal.

The device may comprise an end cap supporting the microphone and the instructions being to overmould the device with a casing material except at least part of the end cap.

According to a fourth aspect of the present invention there is provided apparatus for assisting hearing in a patient with aural atresia, the apparatus comprising:

a hearing device at least partially in the form of an auricle comprising an electromagnet; and a bone implant for mounting in the skull, the bone implant comprising a housing and a magnetic mass suspended within the housing such that vibrations of the magnetic mass along a first axis are mechanically coupled into the housing;

wherein the hearing device is configured to drive its electromagnet so as to, when the hearing device is fixed to the skull in place of or over a natural auricle such that the electromagnet lies over the bone implant, cause the magnetic mass to vibrate along the first axis within the housing.

BRIEF DESCRIPTION OF THE DRAWINGS

The present invention will now be described by way of example with reference to the accompanying drawings. In the drawings.

DETAILED DESCRIPTION OF THE INVENTION

The following description is presented by way of example to enable any person skilled in the art to make and use the invention. The present invention is not limited to the embodiments described herein and various modifications to the disclosed embodiments will be readily apparent to those skilled in the art.

There is provided improved apparatus for assisting hearing in humans and animals which addresses the shortcomings of conventional hearing aid devices. There is also provided a bone implant which represents improved apparatus for coupling vibrational energy into the temporal bone. There is also provided a hearing aid device adapted for wear in the ear canal and for inducing vibration in the bone implant.

Figure 1:
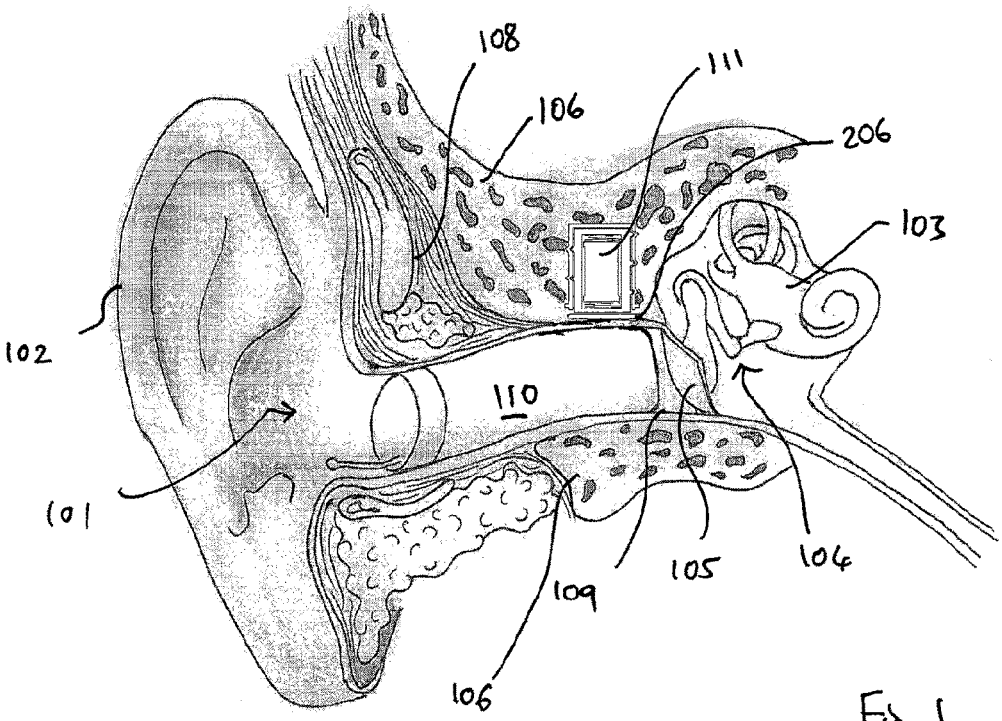
FIG. 1 shows a cross-sectional representation of the human ear with a bone implant and hearing aid device in-situ.

A cross-sectional representation of the human ear is shown in FIG. 1. The ear canal 101 provides a channel along which environmental sounds captured by the auricle 102 are directed to the tympanic membrane 105. Vibrational movement of the tympanic membrane leads to vibrational movement of the auditory ossicles (the bones of the middle ear) 104 which in turn causes vibrations of the fluid in the cochlea 103. The cochlea is the sensory organ by which sounds are detected and converted into signals for processing by the nervous system.

The ear canal 101 is lined along its length by a layer of skin 109. The skin lining the outer third of the ear canal is thick and lies over a layer of soft tissue and cartilage 108, supports hair follicles and cerumen glands which produce ear wax. The skin lining the inner two-thirds of the ear canal is thin and lies directly over the temporal bone 106 which surrounds the ear canal.

FIG. 1 further indicates the approximate position of a hearing aid device 110 and a bone implant 111 configured according to the principles described herein.

Figure 2:
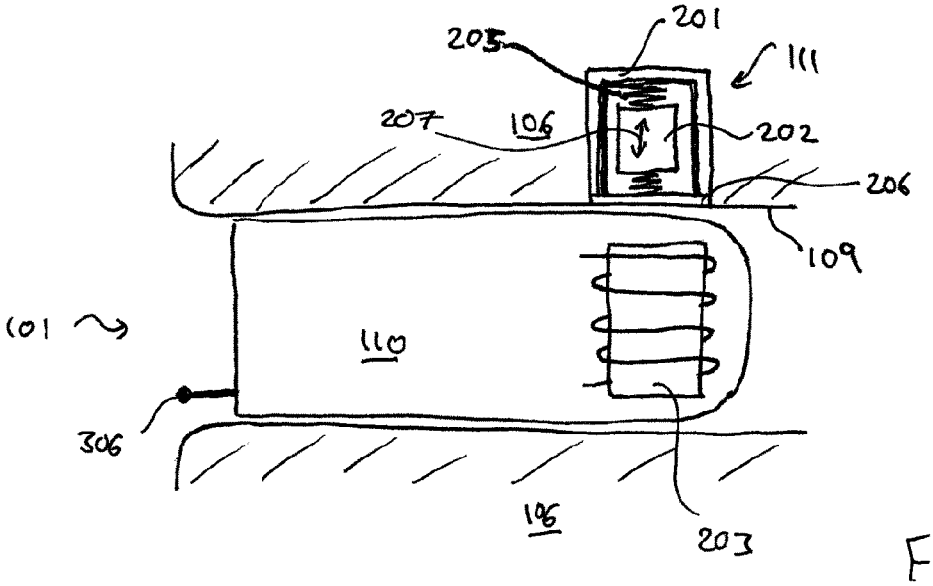
FIG. 2 is a schematic cross-sectional view of a hearing aid device and bone implant according to a preferred embodiment.

FIG. 2 is a schematic cross-sectional view of the hearing aid device 110 and bone implant 111 shown in-situ in FIG. 1. The bone implant is located in the temporal bone 106 adjacent to the ear canal and the hearing aid device is located in the ear canal 101.

The bone implant 111 comprises a magnetic mass 202 which is suspended within a housing 201 so as to allow the magnet to move relative to the housing and to mechanically couple the movement of the magnet to the housing. The magnetic mass will be loosely referred to herein as a "magnet". The magnetic mass 202 may be a permanent magnet, a ferromagnet or a ferrimagnet. The magnet is suspended by one or more elastic members 205 arranged to provide a restoring force as the magnet moves away from a neutral centre position within the housing. The magnet and elastic members thus together form a harmonic system which will oscillate when the magnet is deflected away from its neutral position. The one or more elastic members 205 couple the oscillations of the magnet into the bone in which the implant is located so as to cause vibrations in the bone which may be conducted through the skull to the cochlea on either on the near or far side of the head. The one or more elastic members 205 may comprise one or more springs. In the example shown in FIG. 2, the elastic members comprise two compression springs, one at each end of the magnet so as to locate the magnet in a central position within the housing and provide a restoring force which acts to centre the magnet should it be deflected relative to the housing along its axis of motion 207.

The bone implant may be configured so as to constrain the motion of the magnet along a defined axis—for example, the magnet 202 may have a single degree of freedom of motion as indicated by arrow 207. This may be achieved through the use of any suitable guide means. For example, the magnet and housing may be cooperatively shaped such that the magnet can slide along a channel within the housing, the orientation of the channel defining the axis of the motion of the magnet. The magnet and/or any channel or other surface of the housing with respect to which the magnet moves may be coated with a low friction material such as Teflon®, Keronite®, or a thin metallic or carbon-based layer deposited by CVD or PVD, as is known in the art.

The hearing aid device 110 comprises an electromagnet 203. The electromagnet may comprise a magnetic core of high permeability (e.g. soft iron) about which a conductive wire is wound (e.g. copper) so as to generate a magnetic field having a pole at each end of the core.

When the hearing aid device 110 and bone implant 111 are arranged as shown in FIG. 2 such that the polar axis of the electromagnet 203 is aligned with the axis of movement defined for magnet 202 in its housing, the magnetic field generated by the electromagnet will exert a force on the magnet 202 which causes the magnet to move along that axis. An oscillating magnetic field will cause the magnet to oscillate. If the magnet is a permanent magnet the axis of movement is substantially parallel to the polar axis of the permanent magnet. The magnetic field generated by the electromagnet can be controlled by varying the direction and level of the current through the coils of the electromagnet 203. By providing an alternating current through the coils of the electromagnet, the hearing device can therefore cause the magnet suspended in the bone implant to oscillate up and down as the polarity of the magnetic field (and hence its permeable core) switches back and forth. The frequency of oscillation of the magnet can be controlled by varying the frequency of the alternating current driving the electromagnet.

Bone implant 111 is rigidly fixed into the temporal bone 106. Oscillations of the magnet 202 suspended within the housing of the bone implant may therefore impart vibrational energy into the temporal bone which can be detected by the cochlea 103. In this manner, when the hearing aid device is located suitably in the ear canal, sound can be transmitted into the cochlea of the patient through appropriate control of the current through the electromagnet of the hearing aid device 110.

In the embodiment shown in FIGS. 1 and 2, the bone implant is located in the temporal bone 106 such that it is approximately flush with the surface of the temporal bone which is covered by a lining of skin 109. The end of the bone implant facing into the ear canal may be coated with or covered over by a material 206 which promotes the regrowth of healthy skin 109 over the implant once it has been located in the bone. The material 206 may be in the form of a coating or a thin disc which is located over the bone implant once it is in position in the bone. The material 206 may be cartilage, bone or a synthetic material for supporting skin growth (such as a synthetic collagen matrix). Preferably the material 206 is a thin disc of cartilage harvested from the patient (e.g. from their auricle), a cadaver or animal (such as a pig). Cartilage will integrate around its edge with the temporal bone and provide a natural cover for the bone implant into which the overlying skin can integrate, avoiding problems with the overlying skin becoming irritated or suffering from granulation and scarring. In other examples, the material 206 may be a biocompatible polymer shaped to fill any recesses on the surface of the bone implant (e.g. for engagement with a tool to allow implantation and removal of the implant) so as to provide a smooth surface over which skin can grow.

Figure 3:
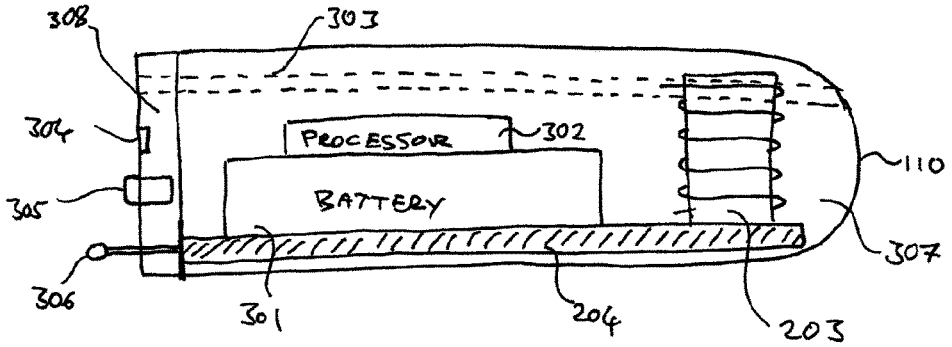
FIG. 3 is a schematic cross-sectional diagram of a hearing aid device according to a preferred embodiment.

FIG. 3 is a schematic cross-sectional diagram of hearing aid device 110. The electromagnet 203 is located at the proximal end of the device (i.e. the end of the device which in-situ in the ear canal is closest to the centre of the head). The electromagnet may be mounted on a rigid structural member 204 which runs substantially along the length of the device (preferably at least roughly following the shape of the patient's ear canal). The structural member 204 may form part of the casing 307. The structural member prevents the electromagnet from moving and causing damage due to reaction forces on the electromagnet due to its interaction with the magnet. By rigidly coupling the electromagnet to other components of the device, it also ensures that the effective mass of the electromagnet is substantially the mass of the hearing aid device which may be many times (and preferably an order of magnitude) larger than the mass of the magnet so as to minimise the acceleration of the device and minimise its movement in the ear canal.

A structural member 204 may not be required in cases where the casing 307 itself provides sufficient structural rigidity to keep the electromagnet in place without excessive movement during use. The structural member 204 may however be plastically deformable such that it can be bent roughly to match the shape of the ear canal prior to over-moulding by a suitable casing 307. A structural member may have a U-shaped profile along the axis of the device so as to roughly match the profile of the ear canal and provide torsional rigidity. The structural member could comprise, for example, a rigid polymer (though perhaps one which may be plastically deformed, e.g. on the application of heat), a titanium alloy or other metal and/or a fibre reinforced polymer.

The components of the device are protected within a casing 307 which may be rigid (e.g. hard acrylic) and/or soft (e.g. a soft acrylic, polyurethane or silicone). It can be advantageous for the casing to substantially comprise a rigid material having regions of a soft material located so as to ensure a snug fit in the ear canal and to reduce the transmission of vibration from the electromagnet to the delicate skin lining the ear canal). Including a material having good acoustic absorption properties (such as silicone) in the casing 307 can help to damp out movements of the device and ensure that the patient wearing the device does not experience any discomfort. Such acoustic absorption materials could be provided, for example, between a rigid region of the casing/a structural member and the ear canal and/or between the electromagnet and the casing/structural member on which it is supported.

The casing is moulded to the ear canal of the patient such that it makes a snug fit in the ear canal. This helps to ensure that the electromagnet is well supported and the hearing aid device will not move excessively within the canal causing discomfort. The surface of the casing may be coated with a hypoallergenic layer (e.g. gold, silver, titanium, or a nano-screen coating).

Figure 10:
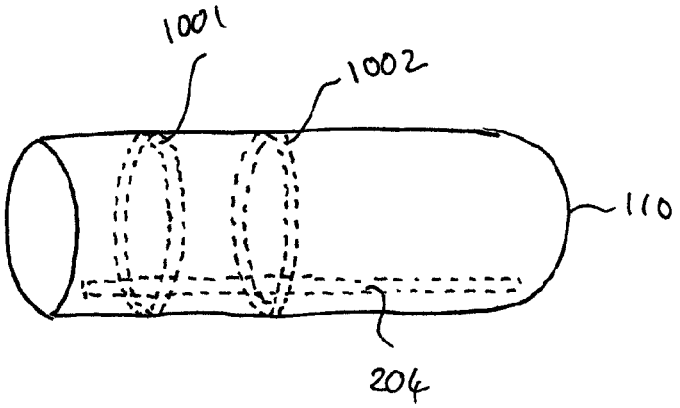
FIG. 10 illustrates an arrangement of structural members in a hearing aid device.

Especially in the case that a soft casing is used, it can be advantageous to provide the hearing aid device with further structural members (which may be defined in the casing itself, e.g. as ribs defined on an internal surface of a rigid casing) which brace the hearing aid device against the walls of the ear canal and help to spread the reactive forces generated at the electromagnet along the ear canal along the length of the device and the ear canal. Such forces tend to generate a moment about an axis roughly orthogonal to the general axis of the hearing aid device. Additional structural members can help to avoid the patient experiencing a tickling sensation or discomfort during wear. For example, FIG. 10 shows a pair of structural rings 1001 and 1002 which run substantially about the circumference of the hearing aid and are rigidly connected to the structural member 204. Each structural ring is preferably encased within the biocompatible material 307 which is selected to provide damping properties and so absorb vibrations of the hearing aid device. In general, there may be any number of further structural members which may have any shape suitable for bracing the structural member 204 to which the electromagnet is mounted. The use of further structural members can help to keep the electromagnet accurately located in the ear canal and avoid the electromagnet and other components moving excessively.

The components of the hearing aid device are encased in a biocompatible material 307 which is comfortable to wear for long periods of time in the ear canal and will not cause skin irritation, such as medical grade silicone or hard acrylic.

The hearing aid device may comprise a tab 306 which allows the device to be easily removed from the ear. The tab is preferably flexible and attached to the structural member 204 or another rigid part of the device. By positioning the tab off-axis, when inserting the device it can further indicate to the patient the correct rotational position of the device such that the electromagnet is correctly aligned with the movement axis of the magnet located in their bone implant. For example, in FIGS. 1 and 3 the tab is centrally located at the lower portion of the distal end of the device when the device is correctly rotationally positioned. In addition, the length of the tab can indicate to the user how far to push the hearing aid into the ear canal. For example, in FIG. 1 the length of the tab is selected such that the tab only just projects beyond the opening of the ear canal when the hearing aid is at the correct depth in the ear canal.

In order to ensure a snug fit in the ear canal, the casing 307 of the hearing aid device is preferably custom-moulded for each patient. The shape of the hearing aid device will then largely dictate the correct position of the hearing aid in the ear canal—i.e. for most patients, the shape of their ear canal will ensure that the device can only be inserted one way into their ear canal and the device will naturally stop at the correct depth and orientation when pushed into the ear canal. The ear mould impression is preferably performed after the bone implant has been fitted and healing is complete so that the mould of the patient's ear includes any resultant changes to the shape of the ear canal and any parts of the bone implant which project into the ear canal. The choice of material used for the casing may be dependent on the particular shape of the patients ear canal and their sensitivity to particular materials.

For a typical adult for example, the hearing aid device may be around 1.6-2.4 cm long (e.g. 20 mm) and around 7-12 mm in diameter (e.g. 12 mm). The electromagnet 203 may be, for example, around 6-11 mm (e.g. 8 mm) in height and around 6-9 mm in diameter (e.g. 8 mm).

The hearing aid device comprises a microphone 304 for receiving sounds in the environment of the patient. Since in use the microphone is positioned at the opening of the ear canal, the microphone picks up sound which would naturally be heard by the patient at that ear were the patient to have a fully functioning ear. In particular, the sound detected at the microphone is naturally captured and filtered by the auricle so as to optimize the transmission of the sound frequencies important in speech communication. This reduces the signal processing which must be performed at the hearing aid. A volume control 305 may be provided to allow control of the output of the hearing aid (e.g. the amplitude of the current through the electromagnet and hence the amplitude of vibrations of the magnet). The volume control could be, for example, a small knob suitable for adjustment by a screwdriver, a magnetic device for control by a magnetic tool brought into sufficiently close proximity to the volume control, or a remotely controlled mechanism (e.g. a suitable electronic component coupled to a radio receiver such as a Bluetooth Low Energy receiver). The microphone, volume control 305 and tab 306 may be provided at an end cap 308 which is appropriately sized for the diameter of the patient's ear canal and may be rigidly connected to the structural member 204. The casing material 307 may be moulded about the components so as to sit flush with the end cap and create a custom fit for the patient.

The hearing aid device may comprise a battery 301 and a processor 302 for processing and amplifying the microphone signal into an alternating current for driving the electromagnet 203. The hearing aid device may optionally comprise a through-port (vent) 303 to connect the air space adjacent to the tympanic membrane to the external environment. This helps to avoid ear infections and also provides a passive route for sound to naturally enter the ear which can be useful for patients with some residual hearing capability (e.g. when the hearing aid is off).

In some embodiments, one or more components of the hearing aid device may be provided outside the ear canal. For example, one or more of the battery 301, the processor 302, and an additional battery may be provided at a second part of the hearing aid device, such as in a second device located behind the ear. Such a part of the hearing aid device could be electrically connected to the part of the hearing aid device located in the ear by, for example, one or more wires, or through electromagnetic coupling.

Figure 4:
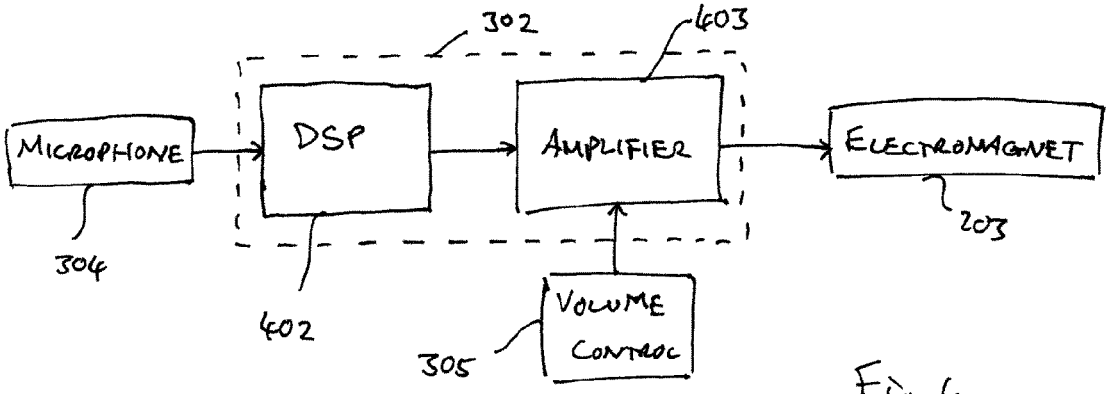
FIG. 4 is a schematic diagram of a processor and its associated components for processing a microphone signal into a drive signal for an electromagnet.

FIG. 4 is a schematic diagram of processor 302 and its associated components. The processor receives the audio signal detected by the microphone 304 and processes the signal into a form suitable for driving the electromagnet 203. The processor 302 may comprise a digital signal processor (DSP) 402 which performs filtering of the microphone signal. The processor 302 may comprise an amplifier 403 which amplifies the filtered microphone signal so as to form an output current for driving electromagnet 203. The degree of amplification performed by the amplifier 403 may be controlled by a volume control 305 such that a higher selected volume causes the processor to generate a higher output current and a lower selected volume causes the processor to generate a lower output current. The processor may comprise one or more integrated circuits and other electronic components.

The DSP may be configured to perform frequency down-conversion so as to convert high frequencies (e.g. above 2 kHz) to lower frequencies (e.g. half the original frequency). The DSP may compress such high frequencies such that, for example, frequencies in the range 2-3 kHz are downconverted and compressed into the frequency range 1-1.5 kHz. Such processing can substantially improve the performance of the hearing aid because (a) lower frequencies are transmitted more efficiently through the skull bone and soft tissues to the cochlea (on either side of the head), and (b) the high frequency hearing of the patient may be relatively more impaired than lower frequencies, especially in older patients.

For example, the processor may perform filtering and amplifying of the microphone signal so as to emphasise frequencies associated with human speech (which is typically around 300-3000 Hz) and suppress both low frequencies (e.g. below 250 Hz) and high frequencies (e.g. above 4000 Hz). The DSP and/or amplifier may be configured to shape the frequency envelope of the microphone signal so as to compensate for one or more of: losses in the oscillatory system of the bone implant (e.g. by selectively amplifying such frequencies); resonances in the oscillatory system of the bone implant (e.g. by selectively suppressing such frequencies); frequency-dependent absorption of vibrational energy by the human body between the bone implant and cochlea (either on the same side or the other side of the head); frequency-dependent hearing impairment of the patient (e.g. for patients with some residual hearing the processor could be configured to selectively filter/amplify frequencies so as to at least partially restore normal hearing to the patient).

The ossicles of the human middle ear have a resonant frequency of around 1-1.5 kHz. In some embodiments, it can be advantageous to arrange that the resonant frequency of the bone implant lies roughly around this range of frequencies so as to, in patients with some remaining middle ear function, ensure good coupling of the vibrations generated by the bone implant to the bones of the middle ear. In other embodiments, it can be advantageous to arrange that the resonant frequency of the bone implant lies outside or to the periphery of the resonant range of frequencies of the middle ear so as to avoid the bone implant having an excessively non-linear frequency response within or close to the operating frequencies of the in-ear device (e.g. 250 Hz to 2-4 kHz). As will be understood from harmonic oscillator theory, tuning of the resonant frequency of the bone implant can be achieved through appropriate selection of the mass and effective spring constant of the means by which the mass is suspended in the bone implant.

Figure 5:
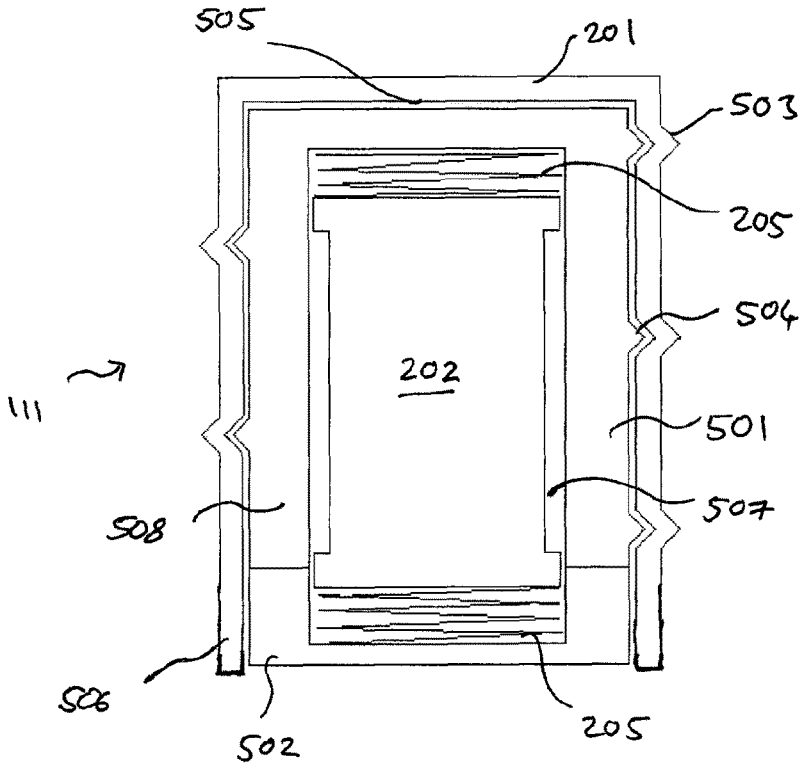
FIG. 5 illustrates a bone implant according to a preferred embodiment.

FIG. 5 is a schematic diagram which shows a first embodiment of the bone implant 111 in which housing 201 comprises two parts: an outer housing 201 and an inner housing 501. Outer housing 201 is provided with an outer thread 503 such that the outer housing represents a bone screw that can be inserted into a suitable cavity drilled into the temporal bone 106. In other examples the bone implant may be secured in the temporal bone in any suitable manner, e.g. through the use of bone cement. The inner housing 501 of the bone implant carries the suspended magnet 202 within a chamber 507. The inner housing 501 may be provided with an outer thread 504 adapted to engage with a complimentary inner thread of the outer housing 201 so as to allow the inner housing to be removably fixed into the outer housing. As shown in FIG. 5, the inner and outer threads of the outer housing may be defined by a common thread profile such that the indent of the inner thread and the projection of the outer thread are aligned to one another. This can help to minimise the thickness of the outer housing without the inner thread introducing weakness into the outer housing due to the removal of material in order to define the thread.

The external surface(s) of the outer housing of the bone implant may include dents, projections or other features which deviate from a perfect cylinder so as to encourage osseointegration of the outer housing and to help prevent rotation of the outer housing in the bone when the inner housing is being inserted and/or removed. For example, the end of the outer housing which is to be located furthest from the ear canal may have a square, pentagonal or hexagonal shape within the bounds of the—in the present example—generally cylindrical shape of the outer housing. This allows the outer housing to be screwed into position whilst providing a shape which will resist rotation of the outer housing once the bone has grown about outer housing.

In some embodiments, the magnetic mass may be located between the inner and outer housings. For example, inner housing 501 may be open-ended such that the elastic member 205 engages with internal surface 505 of the outer housing. In another example, the inner housing may comprise only an end piece 502, with the magnetic mass being located between the end piece 502 and the internal surface 505 of the outer housing.

The outer housing is suitably shaped in one or more places to allow a tool to engage with it and screw the outer housing into a cavity which has been drilled in the temporal bone. For example, the outer housing may comprise a screw head, hexagonal socket, nut profile or other feature adapted to allow a suitable tool to engage with it. Such a feature could, for example, be located within the chamber of the outer housing for receiving the inner housing (e.g. as a hexagonal socket on internal surface 505 adapted to receive a hex driver), or form part of the external profile of the housing (e.g. the end 506 of the outer housing may be nut-shaped so as to receive a socket driver).

The inner housing 501, in this example, may be screwed into the outer housing once it has been located in the bone. In other examples, the inner housing 501 may be permanently or removably fixed into the outer housing by any suitable means, including by adhesive, mechanical clips or fixing wires. The inner housing has defined therein a chamber 507 in which the magnet 202 is suspended. As discussed, the magnet may be any kind of magnetic material, including a permanent magnet, a ferromagnet and a ferrimagnet. The magnetic field of or developed in the magnet is sufficiently high that oscillations of the magnet when driven by the electromagnet of battery-powered hearing aid device 110 develop vibrations of appropriate amplitude for the patient to experience as sound. If magnet 202 is a permanent magnet it may be a neodymium magnet.

The magnet 202 is suspended in the chamber by one or more elastic members 205 which provide a restoring force if the magnet is displaced from a neutral position. The restoring force provided by each elastic member is preferably substantially proportional to the displacement of the magnet so that the magnet represents a harmonic oscillator. The magnet is suspended in the chamber 507 such that, under the influence of an appropriate magnet field, the magnet is free to oscillate along a defined axis. Such an axis of oscillation may be defined by the shape of the magnet 202 and chamber 507—for example, the magnet and chamber may both be cylindrical in shape so as to substantially constrain the magnet to move along the long axis of the cylinder. The magnet and chamber may be shaped so as to prevent rotation of the magnet about the axis of oscillation—for example, the magnet and chamber could have a cross-sectional shape orthogonal to the axis of oscillation which does not have infinite rotational symmetry (e.g. the magnet and chamber could have hexagonal cross-section), or the magnet and chamber may have one or more cooperating guide pieces (e.g. the magnet may have fins which move within slots defined in the walls of the chamber so as to prevent rotation of the magnet). This can avoid unwanted stresses on the elastic members by which the magnet is suspended.

The one or more elastic members 205 may have any suitable configuration. In the example shown in FIG. 5, an elastic member is located at each end of the magnet between the magnet and the end wall of the chamber. These elastic members are represented schematically by helical springs in the figure but could be any kind of elastic member, including an elastomer (which includes polymer foams and gels) or a helical spring of any suitable material. The elastic members are preferably non-magnetic so as to not interfere with an electromagnetic field arranged to drive oscillatory motion of the magnet. In alternative examples, the elastic members may comprise one or more elastic membranes (e.g. polymer or latex membranes) which, in the absence of external forces on the magnet, suspend the magnet in a neutral position and, if the magnet is displaced from that neutral position, provide a restoring force directed to that neutral position.

The inner housing is preferably a sealed unit to prevent the ingress of bodily fluids or gasses into the chamber 507 which may impede the smooth motion of the magnet and/or cause corrosion. The chamber 507 may be filled with air or a particular mix of gases at lower than atmospheric pressure to reduce the fluidic resistance to motion of the magnet. The chamber 507 may be filled with an inert gas, such as helium or argon, to prevent corrosion of the magnet and other components in the chamber. The chamber 507 may be filled with a fluid, gel or foam whose properties are selected so as to achieve one or more of: lubrication of the motion of the magnet within the chamber; a desired resonant frequency of the system; improved coupling of the oscillations of the magnet into vibrations in the bone in which the implant is located; desired damping of the motion of the magnet so as to prevent unwanted oscillations of the magnet due to physical activity of the patient.

The outer housing may be any material suitable for fixation into bone, but is preferably titanium or an alloy thereof. The outer surface of the outer housing which is intended to contact bone may be coated with titanium oxide so as to promote osseointegration of the implant 111 in the bone. The outer housing may be coated with a layer of titanium oxide having an average or RMS surface roughness of the order of tens to hundreds of micrometers.

The inner housing may comprise two parts: a main body 508 which (if present) carries a thread for engagement with a complementary inner thread of the outer housing; and an end cap 502. The end cap may be removably fixed to the main body so as to allow user servicing of the magnet assembly, or it may be permanently fixed in place so as to provide a sealed cartridge which is not user-serviceable. At least the end cap may be non-magnetic so as to not interfere with the interaction of the magnet with a magnetic field generated by the hearing aid device. Preferably the entire inner housing is non-magnetic, such as a biocompatible plastic. The inner housing may be ultra-high molecular weight polyethylene (UHMWPE) or another hard polymer which can support a thread or other means allowing the inner housing to be removably fixed into the outer housing. In less preferred embodiments the inner housing may comprise a titanium alloy.

Providing a two-part bone implant 111 having an outer housing 201 and a replaceable inner housing 501 has several advantages. The inner housing can be straightforwardly replaced (e.g. due to failure, the development of an updated version) without having to remove the outer housing from the bone. Once the bone has been given enough time to osseointegrate about the implant, the outer housing provides a secure socket into which an inner housing may be inserted and removed repeatedly without damage to the bone. The straightforward removal of the inner housing further permits the magnet to be removed prior to any MRI scan which the patient must undergo. In the case the outer housing is a titanium alloy, the outer housing remaining in-situ during an MRI scan represents a small volume of metal which is only weakly paramagnetic and does not pose a problem even in high resolution MRI scanners.

Figure 11:
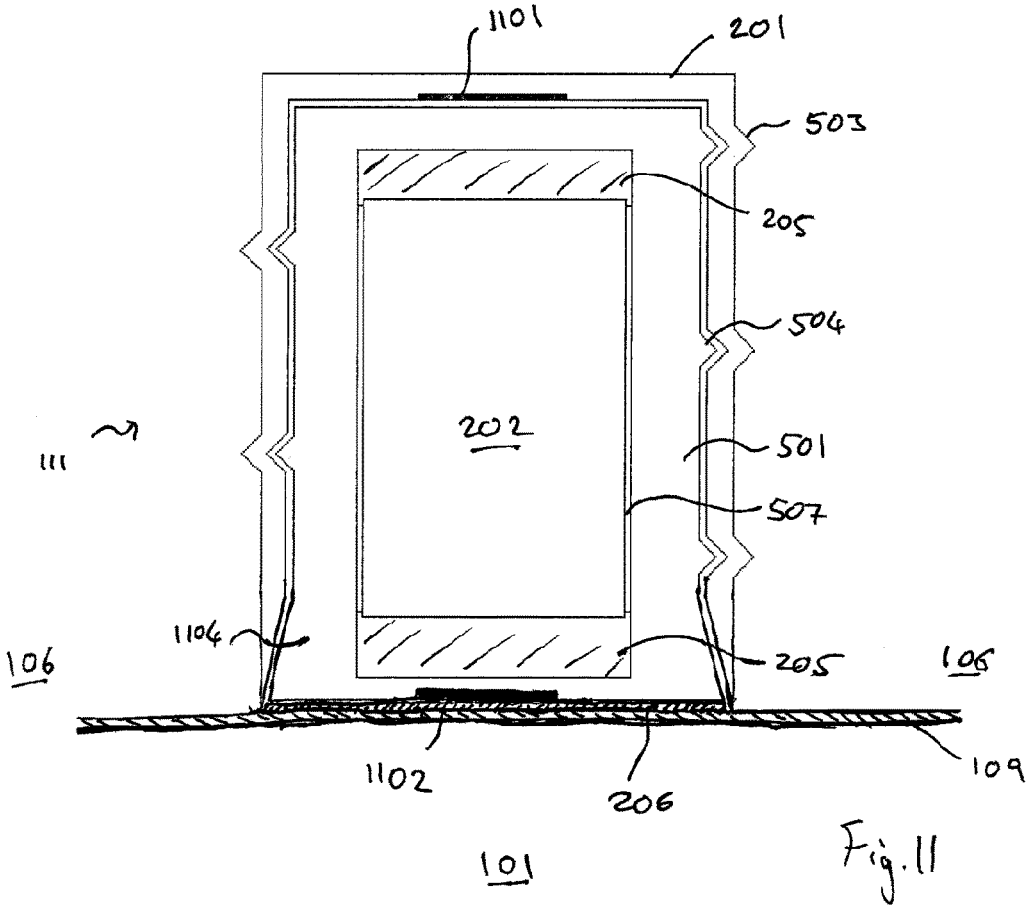
FIG. 11 illustrates a bone implant according to a preferred embodiment.

A preferred embodiment is illustrated in FIG. 11. In this embodiment, the bone implant 111 comprises two parts: an outer housing 201 which represents a bone screw having an outer thread 503 for fixation into a suitable cavity drilled into the temporal bone 106; and an inner housing 501 in which a magnet is suspended 202. The inner housing is provided with a thread 504 which is adapted to mate with a complementary thread of the outer housing so as to enable the inner housing to be removably fixed into the outer housing. The outer housing is provided with engagement feature 1101 adapted to mate with a tool configured for screwing the outer housing into a suitable cavity drilled into the temporal bone. For example, the engagement feature 1101 may be a hexagonal socket adapted to mate with a hex driver.

The inner housing 501 comprises a magnet 202 which is suspended within the housing between two non-magnetic elastomer end pieces 205. The elastomers could, for example, comprise silicone rubber. The end pieces may each be shaped to receive the magnet and hold the magnet axially within the inner housing so as to prevent the magnet rubbing against the inner walls of the chamber 507 in which it is located. The elastomers 205 represent elastic members which provide a restoring force such that the magnet and the elastomers together form a harmonic oscillator. Typically, compared to metallic springs, elastomers will provide improved coupling of the oscillations of the magnet into vibrations in the temporal bone. The chamber 507 may be filled with an oil which acts as a lubricant between the magnet and chamber walls and improves the coupling of the oscillations of the magnet into vibrations in the temporal bone. The magnet preferably substantially fills the volume of chamber 507 which is not occupied by the elastomers 205 so as to maximise the magnetic field with which the electromagnet of the hearing aid device may interact.

The inner housing is provided with engagement feature 1102 adapted to mate with a tool configured for screwing the inner housing into the outer housing. For example, the engagement feature 1102 may be a hexagonal socket adapted to mate with a hex driver.

The outer housing is adapted for implantation into a cavity drilled into bone. If the outer housing is metallic, the cavity may be made deeper than the length of the outer housing such that the metal of the outer housing sits recessed in the cavity away from the region of magnetic interaction between the magnet 202 and electromagnet; the remaining volume of the cavity may be filled by the inner housing and end cap 206. In the example shown in FIG. 11, the outer housing extends almost the full length of the cavity with just a short remaining length of the cavity (e.g. 0.5 mm) to be filled by a disc of cartilage 206 or other suitable material as discussed herein. The walls of the outer housing may be chamfered to a point as they approach the ear canal so as to minimise the volume of metal in the vicinity of the magnetic interaction region; the inner housing may be correspondingly shaped so as to fill the interior volume of the outer housing (indicated by flange 1104).

The bone implant comprising the inner and outer housings and the end piece 206 sits approximately flush in the cavity so as to not project into the ear canal 101. In the present embodiment, the outer housing sits slightly recessed in the bone cavity so as to substantially line the walls of the bone cavity but leave a small volume to be plugged by an end piece 206. In other examples the outer housing may extend the entire length of the cavity so as to avoid any issues with bone growth over the lip of the outer housing into any exposed inner housing/the end piece 206 which could make subsequent removal of the inner housing difficult. This provides maximal surface area for osseointegration between the outer housing and the bone and separates the inner housing from the bone so as to avoid bone growth binding the inner housing and preventing its removal. The inner housing, when screwed into the outer housing, at least substantially plugs the volume of the recess provided within the outer housing.

The outer housing is preferably titanium or an alloy thereof; such materials are generally weakly paramagnetic. Flange 1104 and preferably the entire inner housing except the magnet 202 itself are non-magnetic. For example, the inner housing may substantially be ultra-high-molecular-weight polyethylene (UHMWPE). Part of the inner housing not lying between the magnet 202 and ear canal may be a non-magnetic metal such as a titanium alloy (e.g. a titanium alloy shell could carry the thread 504 into which a UHMWPE body is bonded). This arrangement ensures that the bone implant (and in particular the outer housing) does not interfere with the interaction of the magnetic field of the magnet and the magnetic field generated by the hearing aid device located in ear canal 101. This results in an optimal coupling between the magnetic fields and an efficient transfer of electromagnetic energy into the kinetic oscillations of the magnet.

Any surfaces of the inner housing which come into contact with bone preferably comprise or are coated with a biocompatible material which does not promote osseointegration so as to avoid the bone binding to the inner housing and preventing removal of the magnet assembly. Suitable materials include ultra-high-molecular-weight polyethylene (UHMWPE) and/or a coating of hydroxyapatite or a carbon thin film. Additionally or alternatively, any surfaces of the inner housing which come into contact with bone may be polished smooth so as to minimise osseointegration. Such materials and/or coatings may be used on the surface of the inner housing facing the ear canal over which the end piece 206 is preferably provided.

A thin end piece 206 may be provided between the inner housing and the skin lining the ear canal. The end piece would preferably provide a final plug for the cavity in which the bone implant is installed, with the surface of the end piece lying flush with the surface of the temporal bone in which the implant is installed. The end piece may be a thin disc shaped so as to cover the surface of the inner housing which would otherwise be exposed to the ear canal. The end piece is preferably configured to promote the growth and adhesion of skin over the bone implant so as to maintain a healthy lining of the ear canal. The end piece 206 may be cartilage, bone or a synthetic material for supporting skin growth (such as a synthetic collagen matrix or medical grade silicone coated with type I collagen). Preferably the end piece 206 is a thin disc of cartilage harvested from the patient (e.g. from their auricle), a cadaver or animal (such as a pig). Cartilage will integrate around its edge with the temporal bone and provide a natural cover for the bone implant into which the overlying skin can integrate, avoiding problems with the overlying skin becoming irritated or suffering from granulation and scarring. The end piece may be adapted to engage with engagement feature 1102 on the surface of the inner housing (this can help to hold the end piece in place).

Alternative embodiments will now be described with respect to FIGS. 6-9.

Figure 6:
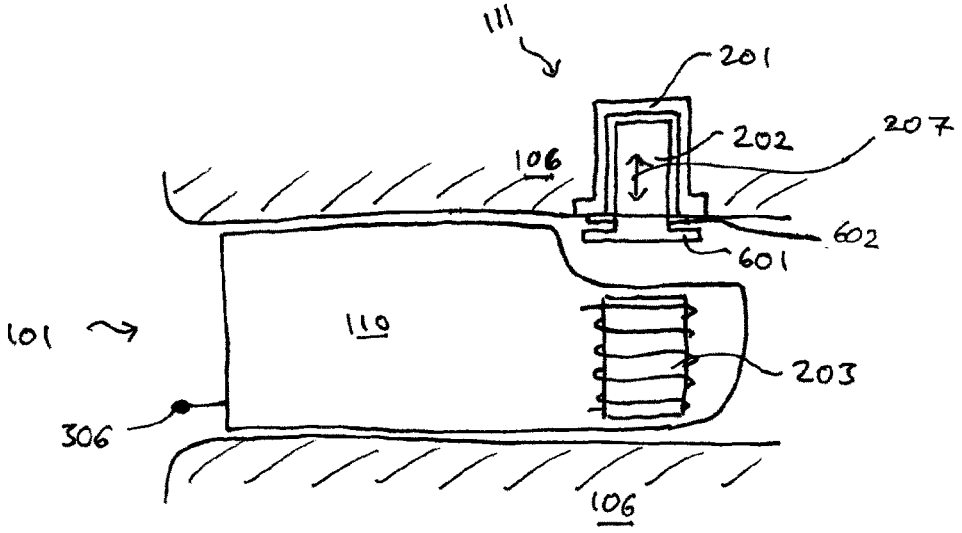
FIG. 6 is a schematic cross-sectional diagram of a hearing aid device according to an alternative embodiment.

FIG. 6 shows a variation to the bone implant and hearing aid device shown in FIG. 2. The magnet 202 of the bone implant 111 in this example projects into the ear canal. As a result, the hearing aid device 110 is shaped such that, in-situ in the ear canal, it fits around the magnet leaving enough room for the end of the magnet projecting into the ear canal to oscillate. The magnet may be suspended in housing 201 by a flexible membrane 602 which seals off the chamber of the housing in which the magnet oscillates so as to prevent the ingress of wax, fluids and other debris from the ear canal. The flexible membrane may be an elastic member 205; there may additionally or alternatively be one or more other elastic members 205 arranged to provide an elastic restoring force for the magnet—for example, a spring or elastomer located between the magnet and the closed internal end of the chamber in which the magnet oscillates. The end of the magnet 202 which projects into the ear canal may be flared so as to form a magnetic plate 601. This can improve the magnetic coupling between the electromagnet and magnet and hence the force exerted on the magnet for a given current through the electromagnet coils.

The arrangement shown in FIG. 6 has the advantage that no parts of the bone implant or soft tissues of the ear canal lie between the magnet 202 and electromagnet 203 which could diminish the coupling between the two. However, the arrangement has the disadvantages that ear wax can build up around the magnet (and in particular between plate 601 and the lining of the ear canal), impeding its motion. The projection of the magnet into the ear canal also means that the height of the electromagnet is limited, which can reduce the strength of the magnetic field that can be generated for a given current through the coils of the electromagnet.

Figure 7:
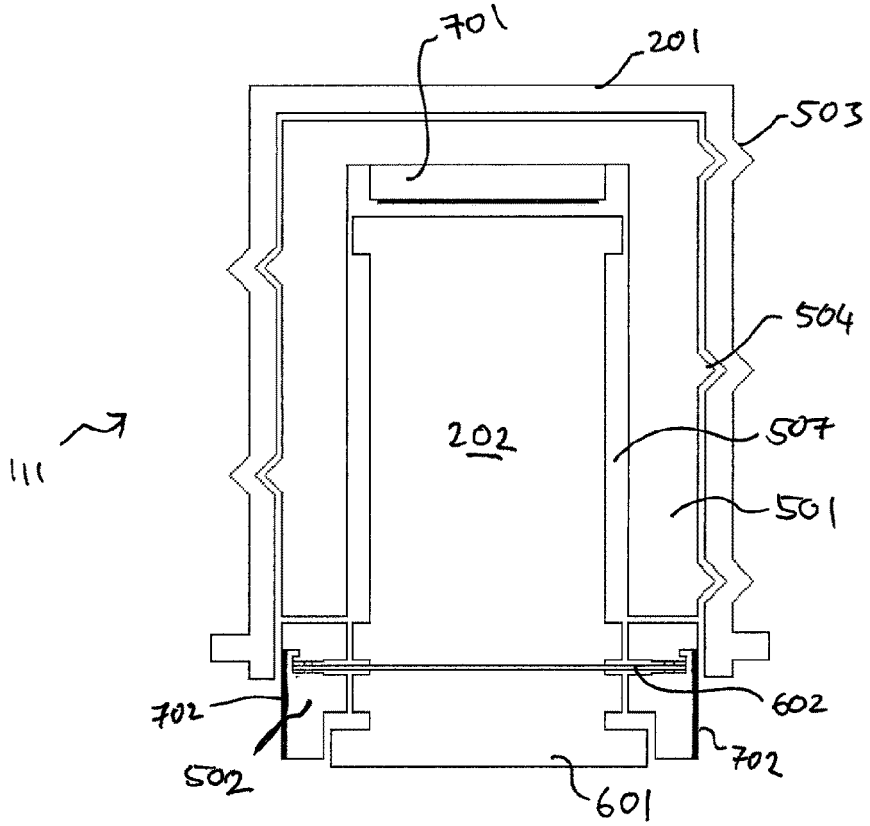
FIG. 7 illustrates a bone implant according to an alternative embodiment.
Figure 8:
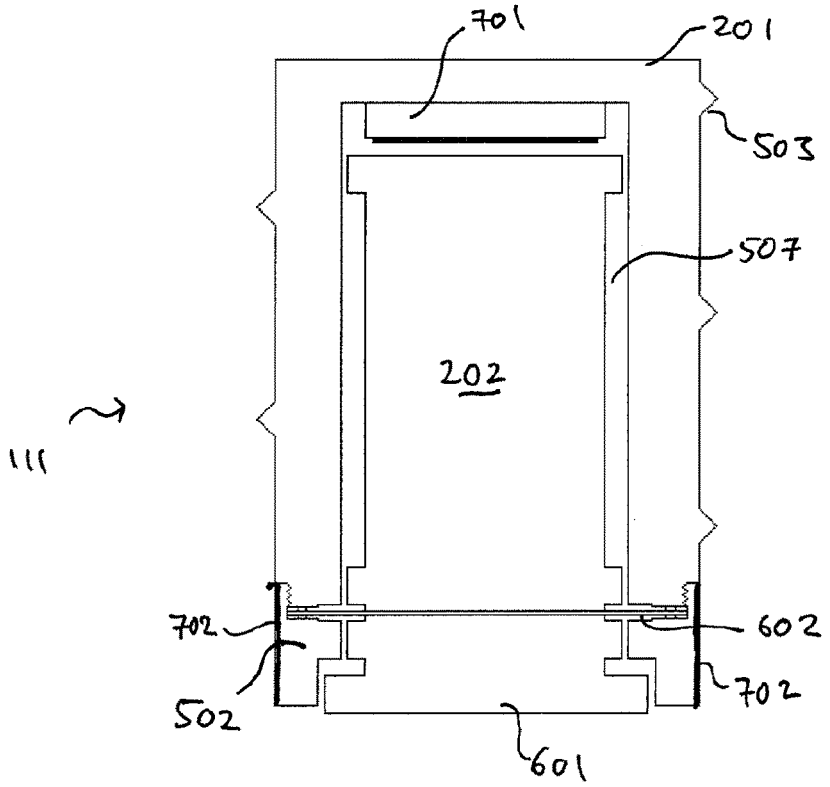
FIG. 8 illustrates a bone implant according to an alternative embodiment.

FIGS. 7 and 8 illustrate two possible configurations of the bone implant 111 of FIG. 6. FIG. 7 is analogous to the bone implants described with respect to FIGS. 5 and 11 in that it comprises two parts: an outer housing 201 which may be screwed into bone and an inner housing 501 which may be screwed into the outer housing and comprises the magnet assembly for generating vibrations in the bone into which the bone implant is fixed. Flexible membrane 602 is shown in more detail in FIG. 7. The magnet may be attached to the membrane by any suitable means, including adhesive, a clamping mechanism (e.g. a band located about the magnet and adapted to pinch the membrane between the band and magnet), and through the use of multiple point fixations, such as screws, pegs or bolts attached into the magnet. Similarly, the membrane may be attached to an end piece 502 of the inner housing by any suitable means, including any of those recited in the previous sentence. In the example shown, the end piece 502 comprises two parts between which the membrane is clamped. The two parts of the end piece may be fixed together in any suitable manner—e.g. by a screw thread or one or more fasteners such as screws, bolts or clips.

Magnetic plate 601 may have a greater diameter than that of the chamber in which the magnet is suspended. The magnetic plate is spaced apart from the open end of the housing such that it does not come into contact with the housing at any point during its possible range of movement. The internal closed end of the chamber may be provided with an elastic buffer 701 so as to prevent the magnet striking the end of the chamber and the magnetic plate 601 striking the open end of the housing end piece 502. The elastic buffer would absorb excess kinetic energy of the magnet so as to slow the magnet less sharply on it reaching the extreme of its permitted range of movement. This avoids the patient experienced loud 'bangs' due to the hard magnet striking the hard end of the chamber. Preferably however, the function of elastic buffer 701 would be performed by an elastic member 205 which further acts to provide a restoring force to the magnet.

FIG. 8 illustrates a variation on the bone implant shown in FIG. 7 in which the housing is provided as a single piece 201. The housing may be provided with an outer thread 503 to allow the implant to be screwed into place in an appropriately-dimensioned cavity drilled into bone. The magnet is however suspended directly within a chamber defined in housing 201; no inner housing is provided which carries the magnet assembly (e.g. the magnet and its elastic members). The housing may include an end piece 502 which can be permanently or releasably attached to the main body of the housing, e.g. by means of a screw mechanism as indicated in the figure. By locating the magnet 202 in the chamber of the housing with the magnet being connected to a flexible membrane 602, the magnet can be suspended in place by attaching the end piece to the main body of the housing so as to clamp the membrane between the end piece and the main body. This arrangement enables a magnet to be straightforwardly located in the housing. One or more elastic members 205 may be provided in the chamber (not shown) so as to augment the elastic restoring force provided by the flexible membrane.

Since it does not employ inner and outer housings, the embodiment shown in FIG. 8 enables the magnet to be larger for a bone implant having given external dimensions or it enables the external dimensions of the bone implant to be smaller for a given size of magnet.

Figure 9:
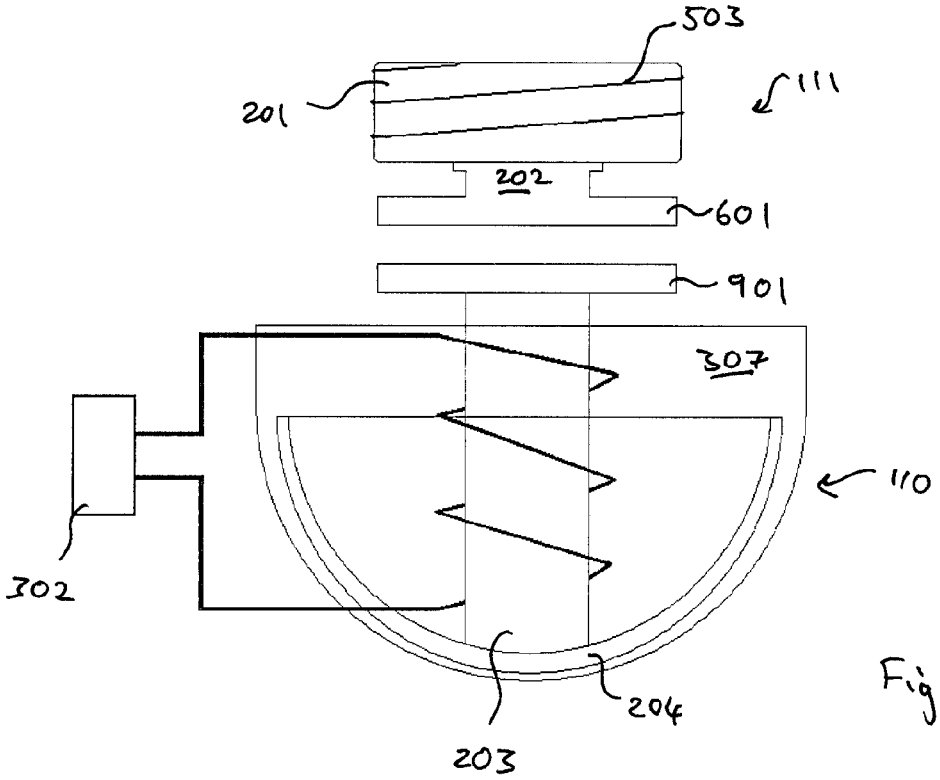
FIG. 9 is a schematic cross-sectional view of a hearing aid device and bone implant along the axis of the hearing aid device according to an alternative embodiment.

FIG. 9 is a schematic cross-sectional view of the hearing aid device 110 and bone implant 111 according to a further variation of the embodiments shown in FIGS. 6 to 8. FIG. 9 represents a schematic cross-section looking along the axis of the hearing aid device from one end, e.g. from its proximal end closest to the tympanic membrane 105 according to the arrangement shown in FIG. 1. The bone implant 111 in the example shown comprises a magnet 202 which is suspended within a housing 201. One end of the magnet 202 projects out of the housing to form a magnetic plate 601 which forms one pole of the magnet.

The hearing aid device 110 comprises an electromagnet 203 which is driven by processor 302 (shown schematically in the figure and not as a true cross-section). The electromagnet comprises a magnetic core of high permeability (e.g. soft iron) about which a conductive wire is wound (e.g. gold or copper) so as to generate a magnetic field having a pole at each end of the core. In the example shown, one end of the core is formed into a core plate 901 which forms one pole of the electromagnet. The electromagnet is mounted on a rigid structural member 204 which preferably runs substantially along the length of the device. The components of the hearing aid device are encased in a biocompatible material 307 which will not cause skin irritation such as medical grade silicone. The core plate 901 (if present) may or may not be encased in material 307. In FIG. 9, the core plate is shown not encased so that no materials lie between the end plates of the magnet 202 and electromagnet 203. This can help to maximise the magnetic coupling between the magnet and electromagnet.

In the embodiments shown in FIGS. 6-9, the surfaces of the bone implant housing which are exposed to the ear canal preferably comprise materials and/or coatings which minimise the growth of skin and scar tissue over the open end of the bone implant and the magnet (which must be free to oscillate if the device is to operate). For example, parts of the housing which project into the ear canal may be coated with hydroxyapatite 702 to encourage natural skin growth around the implant.

In the embodiments described herein, the bone implant is shown positioned in the superior section of the temporal bone. More generally the bone implant may be positioned in any part of the temporal bone adjacent to the ear canal, including in the inferior section of the temporal bone. The choice of where to locate the bone implant may be made in dependence on a CT or MRI scan of the patient to identify the most appropriate region for locating the bone implant for that individual (e.g. the part of the bone which has the greatest bone mass to accommodate the bone implant). In any of the embodiments described herein, the bone implant may comprise one part (e.g. as shown in FIG. 8) or two parts (e.g. as shown in FIG. 5, 7 or 11).

The thickest part of the temporal bone (usually the superior section) adjacent to the ear canal is typically around 1.5-2 cm in an adult. This allows the bone implant to in principle have a total length of up to around 15 mm, depending on the available thickness of temporal bone—although 9 mm would be more typical. The ear canal is typically around 7-12 mm in diameter, depending on the individual. If the bone implant is to be inserted through the ear canal this provides an upper limit on the size of the parts of the bone implant. In order to accommodate outer housings having a length greater than the available diameter of the ear canal the outer housing may be provided in multiple pieces (e.g. a base piece which is screwed into place followed by a second ring-shaped piece which is subsequently screwed into place so as to form part of the wall of the outer housing). An outer housing could have a total length (when assembled in situ) of around 9-15 mm.

In a typical adult having an ear canal diameter of 10 mm the inner housing may be, for example, around 9 mm in length and 8 mm in diameter (typically the maximum diagonal extent of the inner housing which is relevant and it is important not to damage the ear canal when inserting/removing the housings). In such an inner housing, the magnet may, for example, have a diameter of around 6-7 mm and a length of around 3-6 mm. For a neodymium magnet this corresponds to a mass of around 1-2 grams. Smaller or larger housings and hence magnets may be provided for patients having narrower or wider ear canals. Larger inner housings and magnets may be possible if the inner housing is provided in multiple pieces and assembled in-situ.

Different size bone implants may be available to accommodate the different sizes of temporal bones in patients, with the largest size (i.e. largest magnet) possible preferably being used in the patient so as to provide the greatest coupling of vibrations into the temporal bone. Larger bone implants may be provided if the temporal bone is not accessed through the ear canal (e.g. through a hole drilled through the mastoid).

The apparatus described herein provided numerous advantages over conventional devices. Because the hearing aid device 110 is located in the ear canal and the bone implant is surgically implanted in the patient's skull, the apparatus is very discrete and, if noticeable, will appear to others to be a regular air conduction hearing aid. The preferred embodiments (FIGS. 1-5 and 11) in which the magnet of the bone implant is sealed within the bone implant underneath the lining of skin of the ear canal do not suffer from any of the problems associated with having a peg or other component projecting through the skin (as in the case of BAHA devices). This minimises the risk of infection and avoids the need for regular cleaning and/or treatment to prevent skin overgrowth and/or granulation at the puncture site.

Furthermore, because the bone implant is located in the temporal bone close to the cochlea, the transfer of vibrational energy into the cochlea is much more efficient than with devices which locate a vibrator unit at the surface of the skull in the mastoid bone (as in the case of BCI devices). This allows a greater output to be achieved at lower power and with a substantially smaller implant. The bone implant can however be substantially larger than floating transducer devices designed for attachment to the ossicles of the middle ear. The location and size of the bone implant enables the device to be successfully used in patients with unilateral hearing loss since enough vibrational power can be generated at a bone implant located on the deaf side to couple to the functional cochlea on the other side of the head. The bone implant also does not have the risks to the facial nerve associated with implanting BCI and middle ear devices.

Conventional bone conduction devices use inductive coupling to transfer data and energy through the skin to an implant fixed into the mastoid bone. The energy is used to drive a processor which processes the received data and in turn drives a vibrator. Hearing apparatus as described herein avoids the complexity of implanted circuitry and the issues of longevity with such devices, and further avoids the requirement for a large induction coil for receiving sufficient energy to drive the circuitry. By providing a small magnet much closer to the cochlea which can be driven by a low-power electromagnet located within the ear canal, excellent performance can be achieved without the complexity and size of conventional apparatus and in a package which is completely discrete. Despite using a magnet, the apparatus described herein does not suffer from the issues associated with conventional bone conduction devices which comprise a significant volume of metal (typically a titanium alloy). The magnet assembly (e.g. held within an inner housing) may be removed by means of a relatively straightforward procedure should the patient require an MRI or the unit need replacing. The outer housing described in certain embodiments may be left in place in the temporal bone but comprises only a small volume of, typically, a titanium alloy which does not affect MRI images to the same degree as the large housings of conventional bone conduction devices.

Finally, because the bone implant is very well coupled to the bone, the hearing aid device does not cause tickling or irritation of the ear canal which is observed with other bone conduction devices located in the ear canal.

Implanting the Bone Implant

It is advantageous if the bone implant is implanted into the temporal bone through the ear canal. This is possible because the configuration of the bone implant and hearing aid device, and the location of the bone implant close to the cochlea, allow the bone implant to be small enough to be inserted via the ear canal. As discussed above, the largest size bone implant which can be inserted via the ear canal is preferably used for a given patient. Other surgical techniques are however possible, including insertion in the temporal bone via a hole drilled through the mastoid. Such techniques are less preferred since there is a risk of damage to the facial nerve. In contrast, insertion via the ear canal carries a low risk and represents a relatively minor surgical procedure. In particular, for the preferred embodiments in which an outer housing is implanted in the bone into which an inner housing may be removably inserted, it is a minor surgical procedure to remove and replace the inner housing carrying the magnet assembly (e.g. in advance of an MRI scan or due to failure/wear and tear of the magnet assembly).

An exemplary surgical procedure by means of which the bone implant 111 described herein may be inserted into the temporal bone will now be described with respect to FIGS. 12*a*-12*k* and the preferred embodiment of the bone implant shown in FIG. 11.

Figure 12A:
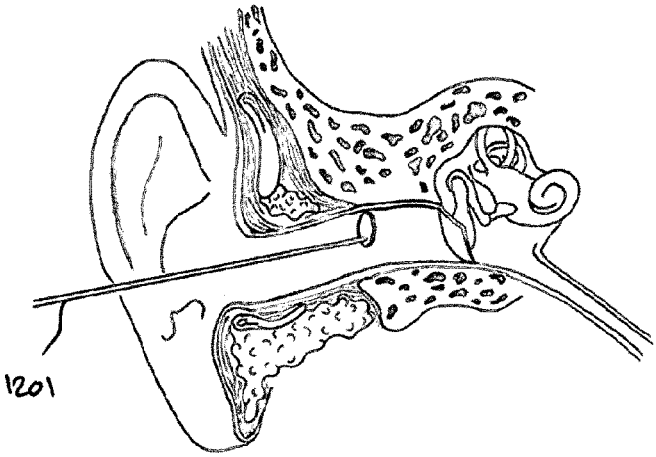
FIGS. 12*a*-12*i* illustrate steps for implanting a bone implant of the preferred embodiment.
Figure 12B:
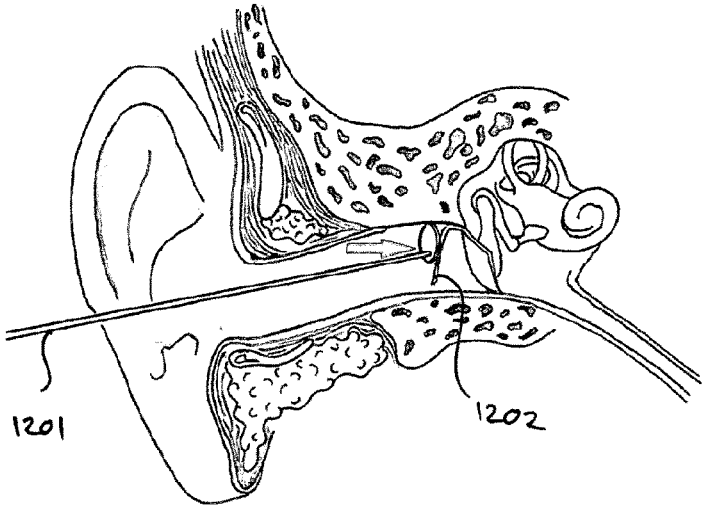

In order to access the temporal bone, a spatule, elevator and/or other suitable surgical tools 1201 are used to cut away a flap of the skin overlying the part of the temporal bone into which the bone implant is to be implanted (FIG. 12*a*). The flap of skin 1202 created is preferably left attached along one side and hanging away from the area of the temporal bone into which the bone implant is to be located (FIG. 12*b*).

Figure 12C:
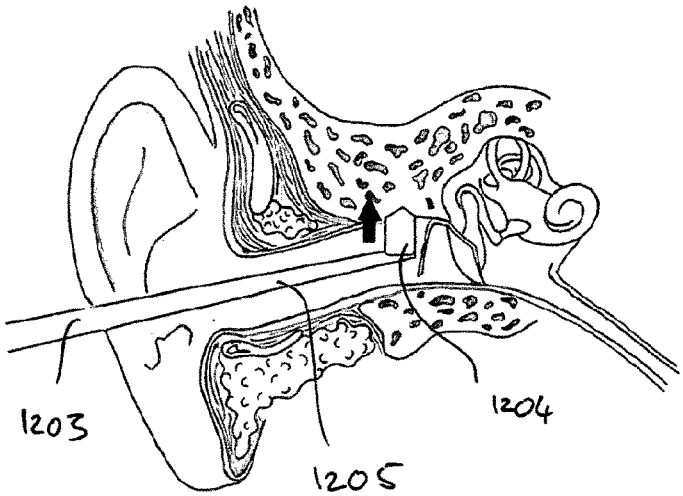
Figure 12D:
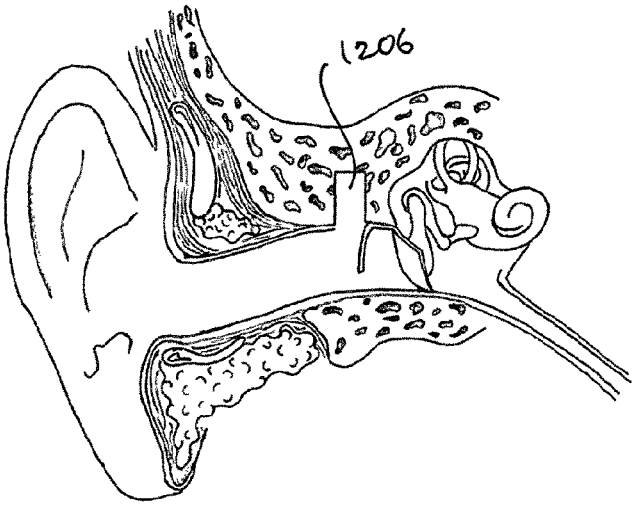

A surgical drill 1203 provided with a drill head 1204 orthogonal to the main shaft of the drill 1205 may then be used to drill a hole of appropriate diameter and depth in the temporal bone (FIG. 12*c*). The drill head may be provided with a lip which contacts the surface of the temporal bone when the required depth for the bone implant is reached and prevents the drill from drilling deeper into the bone. As shown in FIG. 12*d*, a cavity 1206 is thus created in the temporal bone at a location and orientation appropriate for the patient (this may be determined from an MRI scan of the patient prior to drilling). Debris from the drilling may be flushed from the cavity and ear canal once drilling is complete.

Figure 12E:
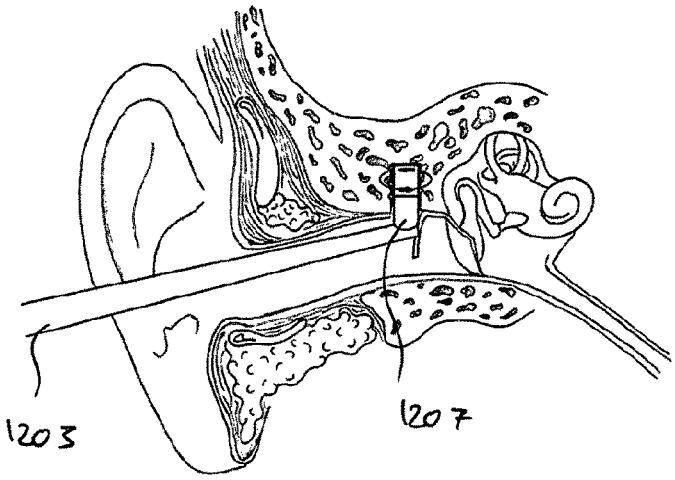

The outer housing 201 of the bone implant 111 is then screwed into the bone by means of an appropriate tool (FIG. 12*e*). For example, the drill head 1204 may be replaced with a hex driver 1207 which engages with a hex socket 1101 of the outer housing so as to allow the outer housing to be screwed into the bone. An outer housing which comprises multiple pieces would be screwed into place in the appropriate order. Once the outer housing is located in the bone, the threaded inner housing 501 carrying the magnet assembly may be inserted by screwing it into the thread provided in the outer housing. The same tool may be used for the inner housing (e.g. a hex driver may be used which engages with hex socket 1102 of the inner housing). Prior to securing the inner housing in the outer housing, it may be necessary to initially locate the inner housing in the thread of the outer housing using one or more tools designed to engage with the outer surface of the inner housing carrying the thread. For example, one or more pinhole recesses may be provided into which a pin tool may be inserted so as to guide the inner housing into engagement with the thread defined in the outer housing. Once the inner housing is partially engaged in the thread, the inner housing may be tightened up using, for example, a hex driver. Threadlock may be used to ensure that the inner housing does not become loose during physical activity of the patient.

Figure 12F:
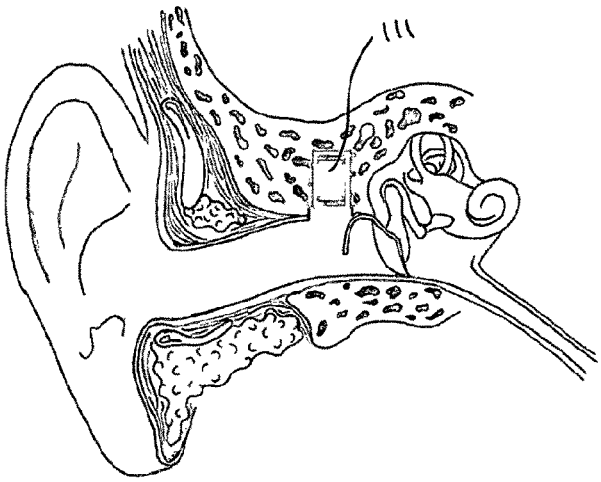

When the inner housing has been secured in the outer housing, the complete bone implant 111 is in-situ in the temporal bone, as shown in FIG. 12*f*.

Figure 12G:
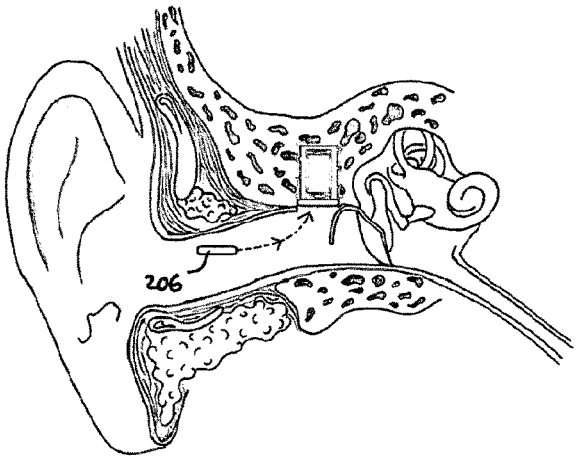
Figure 12H:
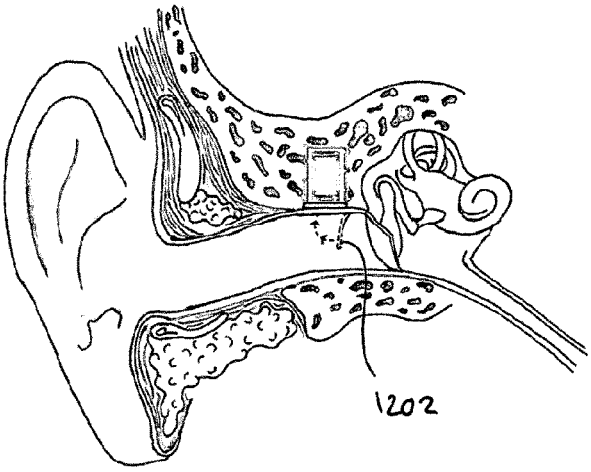

A thin disc of cartilage may then be located over the end of the bone implant so as to plug any remaining volume of the cavity 1206 and provide a good biological substrate for the skin of the ear canal to grow over (FIG. 12*g*). The disc of cartilage may be secured in place by surgical glue. Any hex sockets (e.g. 1120) or other recesses in the end of the bone implant for receiving tools may be plugged by the cartilage or could first be plugged with an appropriate piece of silicone.

The flap of skin 1202 may then be replaced over the disc of cartilage and secured in place by stitches or surgical glue such as Dermabond. Once healed the skin lining the ear canal will form a smooth covering over the bone implant. Surgical packing 1208 may be inserted into the ear canal to protect the healing wound from infection and ensure that the wound stays dry as it heals. After a few days or weeks the packing can be removed and the skin will have at least partially healed over the implant. After a few months the temporal bone will have integrated well about the implant so as to create a permanent fixture in the bone.

Figure 12I:
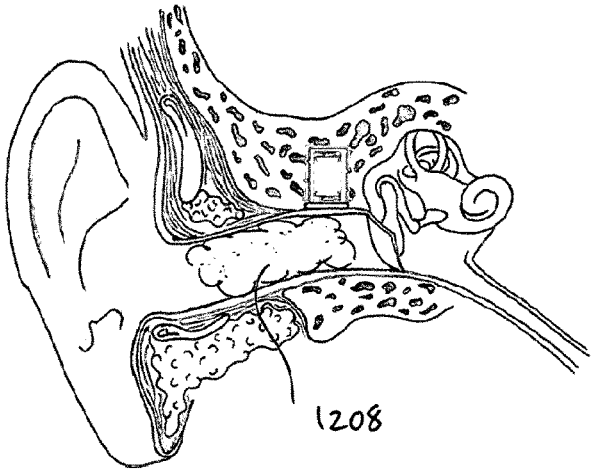
Figure 12J:
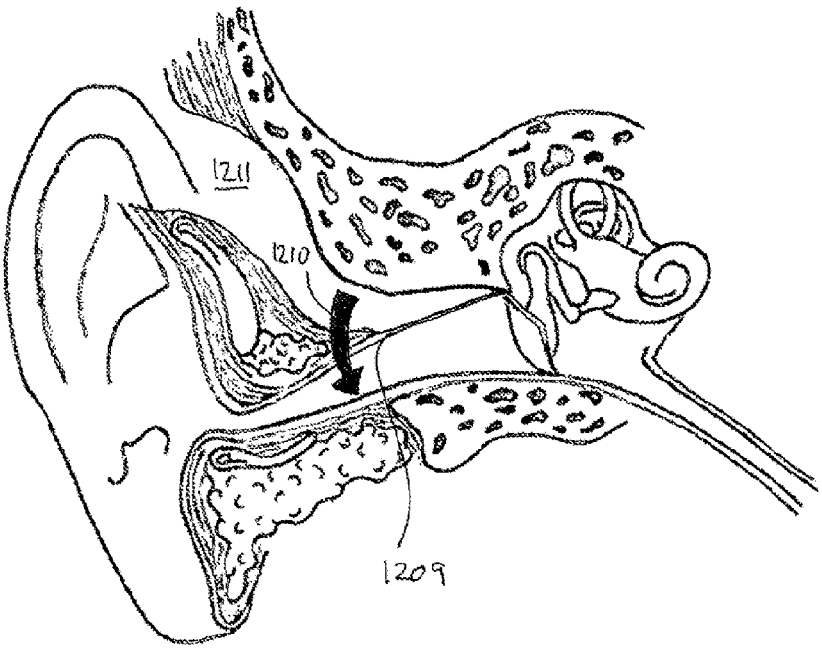
FIG. 12*j* illustrates steps for implanting a bone implant according to another embodiment.

An alternative to the approach shown in FIGS. 12*a* and 12*b* is shown in FIG. 12*j*. Rather than cutting through the skin of the ear canal overlying the bone in which the bone implant is to be implanted, the approach shown in FIG. 12*j* is to make an incision at the outer ear and peel away 1210 the lining of the ear canal 1209 (in this example, the top of the ear canal along with its associated soft tissues such as fat and muscle) from the temporal bone. This creates an opening 1211 through which the steps illustrated in FIGS. 12*c*-12*g* can be performed and the bone implant implanted (typically two-thirds of the way along the ear canal) in accordance with the procedure described above. Once the bone implant is located in-situ, the lining 1209 can be replaced and the external incision stitched, glued or otherwise sealed and allowed to heal. This approach has the advantage that the lining of the ear canal remains intact, with no incision being made through the lining which can help to avoid infection and avoids damage to the lining of the ear canal which has a poorer blood supply than the tissues of the outer ear and so potentially heal less quickly. As shown in FIG. 12*i*, the ear can be packed to aid healing and help the lining to re-attach to the temporal bone.

Figure 13:
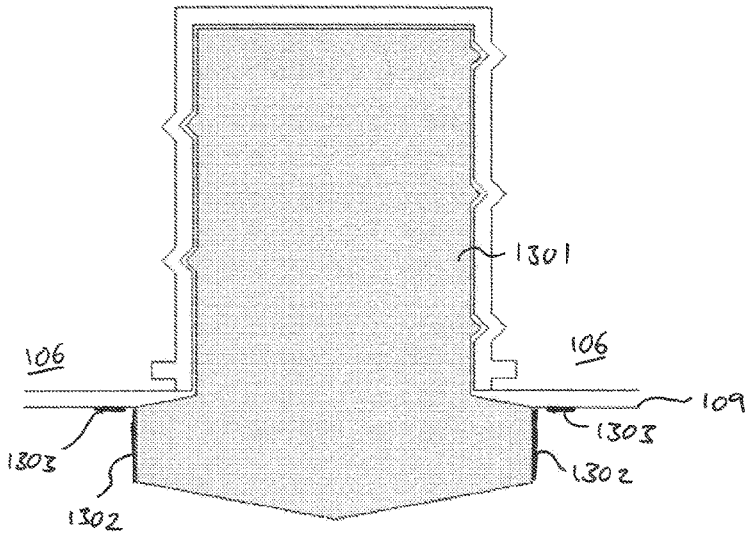
FIG. 13 illustrates a healing abutment which may be used with a bone implant of an alternative embodiment.

In the less preferred embodiments described with respect to FIGS. 6-9, if an outer housing is first located in the temporal bone it can be advantageous to insert a removable healing abutment 1301 coated so as to inhibit the growth of skin over the abutment 1302 and which is left in place for a few days or weeks until the skin has at least partially healed around the abutment and the inner housing (which projects into the ear canal) can be inserted. This is shown in FIG. 13. The healing abutment may be coated with hydroxyapatite and or be highly polished so as to inhibit skin growth. It can alternatively or additionally be useful to create a ring of scar tissue 1303 around the bone implant (or healing abutment if present) so as to prevent the growth of skin over the bone implant and minimise the cleaning required of the parts of the bone implant which project into the ear canal. Scar tissue could be created through, for example, the use of a cauterizer or suitable chemical preparation applied to the skin in a ring about the bone implant projecting through the skin.

Once the bone implant is located in the temporal bone and the skin lining the ear canal is sufficiently healed, a mould of the ear canal may be taken. The casing of the hearing aid device is preferably shaped around the components of the device according to the mould such that the hearing aid device makes a snug fit in the ear canal. This can be achieved by: mounting the components of the device (e.g. the electromagnet, battery and processor) on a rigid structural member which roughly follows the shape of the ear canal of the patient and is sized such that when the microphone lies at the opening of the ear canal the electromagnet is appropriately located and oriented adjacent to the magnet of the bone implant; connecting an end cap to the structural member carrying, for example, a volume control, removal tab and microphone, the end cap being appropriate in size to the diameter of the patient's ear canal (e.g. roughly the same diameter); and then moulding the casing according to the mould taken of the ear canal such that the components are encased in the selected material (e.g. silicone or hard acrylic). A port can be provided in the hearing aid device by including a suitable length of tubing in the mould during moulding: such tubing may attach to an opening in the end cap of the device and be fixed to the components/structural members of the device at one or more points along its length.

Finally the processor of the hearing aid device may be suitably programmed to compensate for the nature of the hearing loss of the patient (e.g. in dependence on their residual hearing capacity and frequency sensitivity, whether the loss is unilateral and on which side relative to the implant, etc.).

Replacement of the magnet assembly or its removal prior to an MRI is a relatively minor procedure: a flap of skin over the implant is cut away as shown in FIGS. 12*a* and 12*b*; the cartilage disc is removed; and the inner housing is unscrewed. If the unit is being replaced, a new inner housing may be immediately inserted into the outer housing. If an MRI scan is to be performed, the ear may be packed until the scan has been performed and then the inner housing (or a new one) may be inserted into the outer housing as described above. If a longer period of time is required (e.g. for a series of MRI scans), a non-magnetic plug may be screwed into the housing, the cartilage replaced and the skin flap glued back into position until such time when a new magnet assembly can be inserted.

Figure 14:
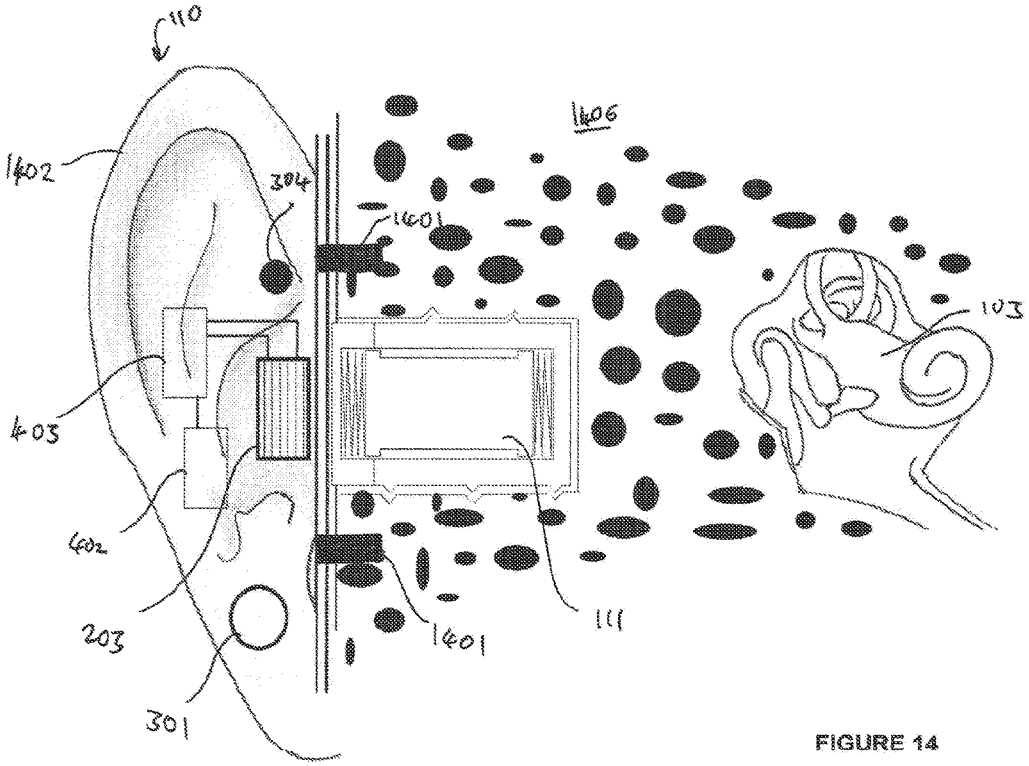
FIG. 14 shows an embodiment for use in patients with aural atresia.

An embodiment of the invention for assisting hearing in a patient with aural atresia and microtia-anotia (or is otherwise missing part of or all of their auricle) is shown in FIG. 14. The hearing aid device 110 is provided in the form of at least part of a synthetic auricle 1402 which may comprise the components discussed above in relation to FIGS. 3 and 4 (a complete synthetic auricle is shown in FIG. 14). The electromagnet 203 may be provided at the centre of the auricle, e.g. behind a synthetic tragus. The microphone 304 may be provided towards the centre of the auricle so as to maximise the position at which sound is normally sampled by a healthy ear. The device may also comprise other components such as a battery 301, DSP 402 and amplifier 403 which operate in the manner discussed above in relation to FIGS. 3 and 4. The locations of the components in FIG. 14 is exemplary only and they may take any positions about the auricle.

Since the patient has aural atresia, the ear canal is substantially absent or blocked with bone. The bone implant 111 is implanted directly into the skull bone 1406 approximately in the location of where the ear canal would typically be. This may be achieved in a similar manner to that discussed above: a skin flap is cut away; a cavity is drilled into the bone; an outer housing is screwed into place; an inner housing carrying the magnet assembly is screwed into the outer housing; a disc of cartilage is provided over the bone implant; and the skin flap is glued back into place. This may be performed such that the distal end of the housing sits flush with the surface of the bone. The magnet assembly may be larger so as to account for the greater distance between magnet and cochlea on the near side. Any of the configurations of bone implant described herein may be used with the present embodiment.

The synthetic auricle 1402 may be fixed to the skull over the implanted bone implant in any suitable manner. In FIG. 14, the auricle is affixed to a pair of abutments 1401 which are fixed into the bone and provide a pair of pegs onto which cooperating engagement elements of the auricle may be removably attached. The abutments may be titanium pegs having a screw thread for insertion into a suitably drilled cavity in the bone. The auricle is attached such that its electromagnet lies over the bone implant and the axis of the electromagnet is aligned with the axis of motion of the magnet. Thus, driving the electromagnet can induce oscillation of the magnet and hence the transmission of vibrations into the skull bone.

Figure 15:
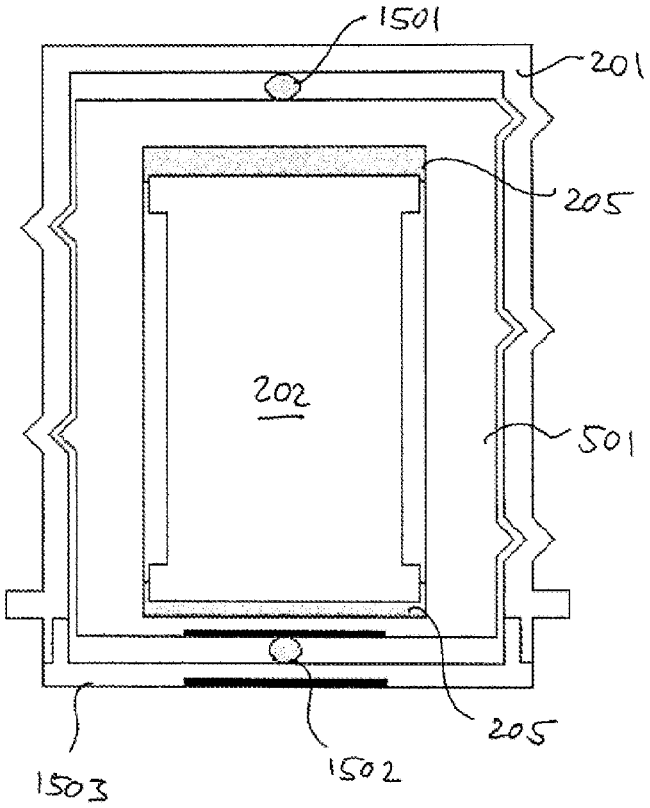
FIG. 15 shows an embodiment of the bone implant according to an embodiment.

An alternative embodiment of the bone implant is shown in FIG. 15. In this embodiment, inner housing 501 is itself coupled to the outer housing by means of elastic members 1501 and 1502. These could be, for example, non-magnetic compression springs or silicone gel pads or beads. The outer housing 201 further comprises an end cap 1503 which holds the inner housing in place via elastic member 1502. The end cap 1503 could, for example, be screwed into the main body of the outer housing. The elastic members 1501 and 1502 could be bonded to the respective parts of the inner or outer housings.

In this embodiment, the inner thread of the outer housing into which the complementary thread of the inner housing is screwed is broader than that of the complementary thread of the inner housing so as to enable the inner housing to move slightly along the axis of vibration of the magnetic mass 202. The degree of motion may be less than 1 mm, less than 0.75 mm, less than 0.5 mm, or less than 0.25 mm. This approach can help to better couple the vibrations of the magnetic mass, along with the internal housing, into the temporal bone in which the outer housing is located. Additionally or alternatively, this approach can be used to prevent the inner housing rattling within the outer housing in the event that the complementary threads of the inner and outer housings allow some play.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. An apparatus for assisting hearing, the apparatus comprising:

an in-ear component for insertion into an ear canal and comprising an electromagnet; and a bone implant for mounting in bone bordering the ear canal, the bone implant comprising a housing and a magnetic mass suspended within the housing such that vibrations of the magnetic mass along a first axis are mechanically coupled into the housing;

wherein the in-ear component is configured to drive its electromagnet so as to, when the in-ear component is located in the ear canal with the electromagnet adjacent to the bone implant, cause the magnetic mass to vibrate along the first axis within the housing; and wherein the bone implant is adapted for implantation such that the first axis is substantially orthogonal to the axis of the ear canal adjacent to the temporal bone, and the in-ear component is shaped such that, when the in-ear component is located in the ear canal with the electromagnet adjacent to the bone implant, the magnetic axis of the electromagnet in use is aligned with the first axis.

2. The apparatus as claimed in claim 1, wherein the magnetic mass is a permanent magnet and the first axis is aligned with a polar axis of the permanent magnet.

3. The apparatus as claimed in claim 1, wherein the bone implant is adapted for mounting into a cavity in the temporal bone such that, in use, no part of the bone implant projects through the skin lining the ear canal.

4. The apparatus as claimed in claim 1, the bone implant further comprising one or more elastic members arranged to elastically couple the magnetic mass to the housing.

5. The apparatus as claimed in claim 4, wherein the elastic members comprise a pair of elastomers each lying on the first axis between the magnetic mass and an internal wall of the housing, the elastomers each being provided with an indentation for receiving a respective end of the magnetic mass so as to centre movement of the magnetic mass along the first axis and substantially prevent the magnetic mass from contacting the housing.

6. The apparatus as claimed in claim 1, wherein the housing comprises two parts: an outer housing adapted for implantation in the temporal bone; and an inner housing in which the magnetic mass is suspended; the inner and outer housings being adapted such that the inner housing may be removably fixed into the outer housing.

7. The apparatus as claimed in claim 6, wherein the inner housing comprises a chamber in which the magnetic mass is suspended, the chamber being filled with one or more of: an inert gas; a lubricating oil; a fluid for, in use, improving mechanical coupling of movement of the magnetic mass into vibrations in the temporal bone.

8. The apparatus as claimed in claim 6, wherein, with the exception of the magnetic mass itself, the inner housing is non-magnetic.

9. The apparatus as claimed in claim 1, the in-ear component further comprising a microphone arranged such that, in use, it is located proximal to the opening of the ear canal, and a processor configured to process a signal from the microphone into an oscillating current for driving the electromagnet.

10. The apparatus as claimed in claim 1, wherein the in-ear component further comprises one or more structural members to which the electromagnet is rigidly connected, the one or more structural members being arranged to, in use, couple reaction forces on the electromagnet substantially along the length of the in-ear component.

11. The apparatus as claimed in claim 1, wherein the bone implant is adapted for mounting into a cavity in the temporal bone such that, in use, at least part of the magnetic mass projects out of the housing through the skin lining the ear canal.

12. The apparatus as claimed in claim 11, wherein the magnetic mass is substantially suspended within a chamber of the housing and that part of the magnetic mass projecting out of the housing comprises an end plate greater in diameter than the diameter of the chamber.

13. The apparatus as claimed in claim 12, wherein the magnetic mass is elastically coupled to the housing by a membrane which further acts to seal off the chamber from the ear canal.

14. The apparatus of claim 1, wherein the housing of the bone implant has a threaded recess; and wherein the bone implant further comprises:

a threaded insert adapted to mate with the threaded recess so as to allow the insert to be removably engaged within the housing, the insert having a magnetic mass suspended therein such that, in use when the insert is engaged within the housing, vibrations of the magnetic mass along a first axis are mechanically coupled into the housing.

15. The apparatus as claimed in claim 14, wherein, in use when the insert is engaged within the housing, no part of the bone implant projects through the skin lining the ear canal.

16. The apparatus as claimed in claim 14, the bone implant further comprising one or more elastic members arranged to elastically couple the magnetic mass to the housing, wherein the elastic members comprise a plurality of elastomers arranged so as to elastically restrain movement of the magnetic mass along a first axis substantially parallel to the axes of the threads of the housing and insert.

17. The apparatus as claimed in claim 16, wherein the elastic members are adapted so as to inhibit movement in directions orthogonal to a first axis substantially parallel to the axes of the threads of the housing and insert and substantially prevent the magnetic mass from contacting the housing.

18. The apparatus as claimed in claim 16, wherein the magnetic mass and elastic members are cooperatively adapted so as to inhibit rotation of the magnetic mass about a first axis substantially parallel to the axes of the threads of the housing and insert.

* * * * *